US007741934B2

(12) United States Patent
Gorrell et al.

(10) Patent No.: US 7,741,934 B2
(45) Date of Patent: Jun. 22, 2010

(54) COUPLING A SIGNAL THROUGH A WINDOW

(75) Inventors: Jonathan Gorrell, Gainesville, FL (US); Mark Davidson, Florahome, FL (US)

(73) Assignee: Virgin Islands Microsystems, Inc., St. Thomas, VI (US)

( * ) Notice: Subject to any disclaimer, the term of this patent is extended or adjusted under 35 U.S.C. 154(b) by 913 days.

(21) Appl. No.: 11/418,128

(22) Filed: May 5, 2006

(65) Prior Publication Data

US 2007/0257749 A1 Nov. 8, 2007

(51) Int. Cl.
*H01P 7/06* (2006.01)

(52) U.S. Cl. ..... 333/227; 333/230; 333/252

(58) Field of Classification Search ..... 333/252, 333/230, 227, 157, 208, 211, 212
See application file for complete search history.

(56) References Cited

U.S. PATENT DOCUMENTS

| | | | |
|---|---|---|---|
| 1,948,384 | A | 2/1934 | Lawrence |
| 2,307,086 | A | 1/1943 | Varian et al. |
| 2,431,396 | A | 11/1947 | Hansell |
| 2,473,477 | A | 6/1949 | Smith |
| 2,634,372 | A | 4/1953 | Salisbury |
| 2,932,798 | A | 4/1960 | Kerst et al. |
| 2,944,183 | A | 7/1960 | Drexler |
| 2,966,611 | A | 12/1960 | Sandstrom |
| 3,231,779 | A | 1/1966 | White |
| 3,297,905 | A | 1/1967 | Rockwell et al. |
| 3,315,117 | A | 4/1967 | Udelson |
| 3,387,169 | A | 6/1968 | Farney |
| 3,543,147 | A | 11/1970 | Kovarik |
| 3,546,524 | A | 12/1970 | Stark |
| 3,560,694 | A | 2/1971 | White |
| 3,571,642 | A | 3/1971 | Westcott |
| 3,586,899 | A | 6/1971 | Fleisher |
| 3,761,828 | A | 9/1973 | Pollard et al. |
| 3,886,399 | A | 5/1975 | Symons |

(Continued)

FOREIGN PATENT DOCUMENTS

EP 0237559 B1 12/1991

(Continued)

OTHER PUBLICATIONS

"Array of Nanoklystrons for Frequency Agility or Redundancy," NASA's Jet Propulsion Laboratory, NASA Tech Briefs, NPO-21033. 2001.

(Continued)

*Primary Examiner*—Benny Lee
*Assistant Examiner*—Gerald Stevens
(74) *Attorney, Agent, or Firm*—Davidson Berquist Jackson & Gowdey LLP

(57) ABSTRACT

A device and method is provided that includes a window for coupling a signal between cavities of a device or between cavities of different devices. A wall or microstructure is formed on a surface and defines a cavity. The window is formed in the wall and comprises at least a portion of the wall and is electrically conductive. The cavity can be sized to resonate at various frequencies within the terahertz portion of the electromagnetic spectrum and generate an electromagnetic wave to carry the signal. The window allows surface currents to flow without disruption on the inside surface of the cavity.

40 Claims, 9 Drawing Sheets

U.S. PATENT DOCUMENTS

| | | | |
|---|---|---|---|
| 3,923,568 | A | 12/1975 | Bersin |
| 3,989,347 | A | 11/1976 | Eschler |
| 4,053,845 | A | 10/1977 | Gould |
| 4,282,436 | A | 8/1981 | Kapetanakos |
| 4,450,554 | A | 5/1984 | Steensma et al. |
| 4,453,108 | A | 6/1984 | Freeman, Jr. |
| 4,482,779 | A | 11/1984 | Anderson |
| 4,528,659 | A | 7/1985 | Jones, Jr. |
| 4,589,107 | A | 5/1986 | Middleton et al. |
| 4,598,397 | A | 7/1986 | Nelson et al. |
| 4,630,262 | A | 12/1986 | Callens et al. |
| 4,652,703 | A | 3/1987 | Lu et al. |
| 4,661,783 | A | 4/1987 | Gover et al. |
| 4,704,583 | A | 11/1987 | Gould |
| 4,712,042 | A | 12/1987 | Hamm |
| 4,713,581 | A | 12/1987 | Haimson |
| 4,727,550 | A | 2/1988 | Chang et al. |
| 4,740,963 | A | 4/1988 | Eckley |
| 4,740,973 | A | 4/1988 | Madey |
| 4,746,201 | A | 5/1988 | Gould |
| 4,761,059 | A | 8/1988 | Yeh et al. |
| 4,782,485 | A | 11/1988 | Gollub |
| 4,789,945 | A | 12/1988 | Niijima |
| 4,806,859 | A | 2/1989 | Hetrick |
| 4,809,271 | A | 2/1989 | Kondo et al. |
| 4,813,040 | A | 3/1989 | Futato |
| 4,819,228 | A | 4/1989 | Baran et al. |
| 4,829,527 | A | 5/1989 | Wortman et al. |
| 4,838,021 | A | 6/1989 | Beattie |
| 4,841,538 | A | 6/1989 | Yanabu et al. |
| 4,864,131 | A | 9/1989 | Rich et al. |
| 4,866,704 | A | 9/1989 | Bergman |
| 4,866,732 | A | 9/1989 | Carey et al. |
| 4,873,715 | A | 10/1989 | Shibata |
| 4,887,265 | A | 12/1989 | Felix |
| 4,890,282 | A | 12/1989 | Lambert et al. |
| 4,898,022 | A | 2/1990 | Yumoto et al. |
| 4,912,705 | A | 3/1990 | Paneth et al. |
| 4,932,022 | A | 6/1990 | Keeney et al. |
| 4,981,371 | A | 1/1991 | Gurak et al. |
| 5,023,563 | A | 6/1991 | Harvey et al. |
| 5,036,513 | A | 7/1991 | Greenblatt |
| 5,065,425 | A | 11/1991 | Lecomte et al. |
| 5,113,141 | A | 5/1992 | Swenson |
| 5,121,385 | A | 6/1992 | Tominaga et al. |
| 5,127,001 | A | 6/1992 | Steagall et al. |
| 5,128,729 | A | 7/1992 | Alonas et al. |
| 5,130,985 | A | 7/1992 | Kondo et al. |
| 5,150,410 | A | 9/1992 | Bertrand |
| 5,155,726 | A | 10/1992 | Spinney et al. |
| 5,157,000 | A | 10/1992 | Elkind et al. |
| 5,163,118 | A | 11/1992 | Lorenzo et al. |
| 5,185,073 | A | 2/1993 | Bindra |
| 5,187,591 | A | 2/1993 | Guy et al. |
| 5,199,918 | A | 4/1993 | Kumar |
| 5,214,650 | A | 5/1993 | Renner et al. |
| 5,233,623 | A | 8/1993 | Chang |
| 5,235,248 | A | 8/1993 | Clark et al. |
| 5,262,656 | A | 11/1993 | Blondeau et al. |
| 5,263,043 | A | 11/1993 | Walsh |
| 5,268,693 | A | 12/1993 | Walsh |
| 5,268,788 | A | 12/1993 | Fox et al. |
| 5,282,197 | A | 1/1994 | Kreitzer |
| 5,283,819 | A | 2/1994 | Glick et al. |
| 5,293,175 | A | 3/1994 | Hemmie et al. |
| 5,302,240 | A | 4/1994 | Hori et al. |
| 5,305,312 | A | 4/1994 | Fornek et al. |
| 5,341,374 | A | 8/1994 | Lewen et al. |
| 5,354,709 | A | 10/1994 | Lorenzo et al. |
| 5,446,814 | A | 8/1995 | Kuo et al. |
| 5,485,277 | A | 1/1996 | Foster |
| 5,504,341 | A | 4/1996 | Glavish |
| 5,578,909 | A | 11/1996 | Billen |
| 5,604,352 | A | 2/1997 | Schuetz |
| 5,608,263 | A | 3/1997 | Drayton et al. |
| 5,663,971 | A | 9/1997 | Carlsten |
| 5,666,020 | A | 9/1997 | Takemura |
| 5,668,368 | A | 9/1997 | Sakai et al. |
| 5,705,443 | A | 1/1998 | Stauf et al. |
| 5,737,458 | A | 4/1998 | Wojnarowski et al. |
| 5,744,919 | A | 4/1998 | Mishin et al. |
| 5,757,009 | A | 5/1998 | Walstrom |
| 5,767,013 | A | 6/1998 | Park |
| 5,780,970 | A | 7/1998 | Singh et al. |
| 5,790,585 | A | 8/1998 | Walsh |
| 5,811,943 | A | 9/1998 | Mishin et al. |
| 5,821,836 | A * | 10/1998 | Katehi et al. ..... 333/202 |
| 5,821,902 | A | 10/1998 | Keen |
| 5,825,140 | A | 10/1998 | Fujisawa |
| 5,831,270 | A | 11/1998 | Nakasuji |
| 5,847,745 | A | 12/1998 | Shimizu et al. |
| 5,858,799 | A | 1/1999 | Yee et al. |
| 5,889,449 | A | 3/1999 | Fiedziuszko |
| 5,889,797 | A | 3/1999 | Nguyen |
| 5,902,489 | A | 5/1999 | Yasuda et al. |
| 5,963,857 | A | 10/1999 | Greywall |
| 5,972,193 | A | 10/1999 | Chou et al. |
| 6,005,347 | A | 12/1999 | Lee |
| 6,008,496 | A | 12/1999 | Winefordner et al. |
| 6,040,625 | A | 3/2000 | Ip |
| 6,060,833 | A | 5/2000 | Velazco |
| 6,080,529 | A | 6/2000 | Ye et al. |
| 6,117,784 | A | 9/2000 | Uzoh |
| 6,139,760 | A | 10/2000 | Shim et al. |
| 6,180,415 | B1 | 1/2001 | Schultz et al. |
| 6,195,199 | B1 | 2/2001 | Yamada |
| 6,222,866 | B1 | 4/2001 | Seko |
| 6,278,239 | B1 | 8/2001 | Caporaso et al. |
| 6,281,769 | B1 | 8/2001 | Fiedziuszko |
| 6,297,511 | B1 | 10/2001 | Syllaios et al. |
| 6,301,041 | B1 | 10/2001 | Yamada |
| 6,309,528 | B1 | 10/2001 | Taylor et al. |
| 6,316,876 | B1 | 11/2001 | Tanabe |
| 6,338,968 | B1 | 1/2002 | Hefti |
| 6,370,306 | B1 | 4/2002 | Sato et al. |
| 6,373,194 | B1 | 4/2002 | Small |
| 6,376,258 | B2 | 4/2002 | Hefti |
| 6,407,516 | B1 | 6/2002 | Victor |
| 6,441,298 | B1 | 8/2002 | Thio |
| 6,448,850 | B1 | 9/2002 | Yamada |
| 6,453,087 | B2 | 9/2002 | Frish et al. |
| 6,470,198 | B1 | 10/2002 | Kintaka et al. |
| 6,504,303 | B2 | 1/2003 | Small |
| 6,525,477 | B2 | 2/2003 | Small |
| 6,534,766 | B2 | 3/2003 | Abe et al. |
| 6,545,425 | B2 | 4/2003 | Victor |
| 6,552,320 | B1 | 4/2003 | Pan |
| 6,577,040 | B2 | 6/2003 | Nguyen |
| 6,580,075 | B2 | 6/2003 | Kametani et al. |
| 6,603,781 | B1 | 8/2003 | Stinson et al. |
| 6,603,915 | B2 | 8/2003 | Glebov et al. |
| 6,624,916 | B1 | 9/2003 | Green et al. |
| 6,636,185 | B1 | 10/2003 | Spitzer et al. |
| 6,636,534 | B2 | 10/2003 | Madey et al. |
| 6,636,653 | B2 | 10/2003 | Miracky et al. |
| 6,640,023 | B2 | 10/2003 | Miller et al. |
| 6,642,907 | B2 | 11/2003 | Hamada et al. |
| 6,687,034 | B2 | 2/2004 | Wine et al. |
| 6,700,748 | B1 | 3/2004 | Cowles et al. |
| 6,724,486 | B1 | 4/2004 | Shull et al. |
| 6,738,176 | B2 | 5/2004 | Rabinowitz et al. |
| 6,741,781 | B2 | 5/2004 | Furuyama |
| 6,777,244 | B2 | 8/2004 | Pepper et al. |
| 6,782,205 | B2 | 8/2004 | Trisnadi et al. |

6,791,438 B2 9/2004 Takahashi et al.
6,800,877 B2 10/2004 Victor et al.
6,801,002 B2 10/2004 Victor et al.
6,819,432 B2 11/2004 Pepper et al.
6,829,286 B1 12/2004 Guilfoyle et al.
6,834,152 B2 12/2004 Gunn et al.
6,870,438 B1 3/2005 Shino et al.
6,871,025 B2 3/2005 Maleki et al.
6,885,262 B2 4/2005 Nishimura et al.
6,900,447 B2 5/2005 Gerlach et al.
6,909,092 B2 6/2005 Nagahama
6,909,104 B1 6/2005 Koops
6,924,920 B2 8/2005 Zhilkov
6,936,981 B2 8/2005 Gesley
6,943,650 B2 9/2005 Ramprasad et al.
6,944,369 B2 9/2005 Deliwala
6,952,492 B2 10/2005 Tanaka et al.
6,953,291 B2 10/2005 Liu
6,954,515 B2 10/2005 Bjorkholm et al.
6,965,284 B2 11/2005 Maekawa et al.
6,965,625 B2 11/2005 Mross et al.
6,972,439 B1 12/2005 Kim et al.
6,995,406 B2 2/2006 Tojo et al.
7,010,183 B2 3/2006 Estes et al.
7,064,500 B2 6/2006 Victor et al.
7,068,948 B2 6/2006 Wei et al.
7,092,588 B2 8/2006 Kondo
7,092,603 B2 8/2006 Glebov et al.
7,122,978 B2 10/2006 Nakanishi et al.
7,130,102 B2 10/2006 Rabinowitz
7,177,515 B2 * 2/2007 Estes et al. ..... 385/130
7,194,798 B2 3/2007 Bonhote et al.
7,230,201 B1 6/2007 Miley et al.
7,253,426 B2 8/2007 Gorrell et al.
7,267,459 B2 9/2007 Matheson
7,267,461 B2 9/2007 Kan et al.
7,309,953 B2 12/2007 Tiberi et al.
7,342,441 B2 3/2008 Gorrell et al.
7,362,972 B2 4/2008 Yavor et al.
7,375,631 B2 5/2008 Moskowitz et al.
7,436,177 B2 10/2008 Gorrell et al.
7,442,940 B2 10/2008 Gorrell et al.
7,443,358 B2 10/2008 Gorrell et al.
7,470,920 B2 12/2008 Gorrell et al.
7,473,917 B2 1/2009 Singh
7,586,097 B2 9/2009 Gorrell et al.
7,586,167 B2 9/2009 Gorrell et al.
2001/0002315 A1 5/2001 Schultz et al.
2001/0025925 A1 10/2001 Abe et al.
2002/0009723 A1 1/2002 Hefti
2002/0027481 A1 3/2002 Fiedziuszko
2002/0036121 A1 3/2002 Ball et al.
2002/0036264 A1 3/2002 Nakasuji et al.
2002/0053638 A1 5/2002 Winkler et al.
2002/0068018 A1 6/2002 Pepper et al.
2002/0070671 A1 6/2002 Small
2002/0071457 A1 6/2002 Hogan
2002/0122531 A1 9/2002 Whitham
2002/0135665 A1 9/2002 Gardner
2002/0139961 A1 10/2002 Kinoshita et al.
2002/0158295 A1 10/2002 Armgarth et al.
2002/0191650 A1 12/2002 Madey et al.
2003/0010979 A1 1/2003 Pardo
2003/0012925 A1 1/2003 Gorrell
2003/0016421 A1 1/2003 Small
2003/0034535 A1 2/2003 Barenburu et al.
2003/0103150 A1 6/2003 Catrysse et al.
2003/0106998 A1 6/2003 Colbert et al.
2003/0155521 A1 8/2003 Feuerbaum
2003/0158474 A1 8/2003 Scherer et al.
2003/0164947 A1 9/2003 Vaupel
2003/0179974 A1 9/2003 Estes et al.
2003/0206708 A1 11/2003 Estes et al.
2003/0214695 A1 11/2003 Abramson et al.
2004/0061053 A1 4/2004 Taniguchi et al.
2004/0080285 A1 4/2004 Victor et al.
2004/0085159 A1 5/2004 Kubena et al.
2004/0092104 A1 5/2004 Gunn, III et al.
2004/0108471 A1 6/2004 Luo et al.
2004/0108473 A1 6/2004 Melnychuk et al.
2004/0108823 A1 6/2004 Amaldi et al.
2004/0136715 A1 7/2004 Kondo
2004/0150991 A1 8/2004 Ouderkirk et al.
2004/0171272 A1 9/2004 Jin et al.
2004/0180244 A1 9/2004 Tour et al.
2004/0184270 A1 9/2004 Halter
2004/0213375 A1 10/2004 Bjorkholm et al.
2004/0217297 A1 11/2004 Moses et al.
2004/0218651 A1 11/2004 Iwasaki et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0045832 A1 3/2005 Kelly et al.
2005/0054151 A1 3/2005 Lowther et al.
2005/0067286 A1 3/2005 Ahn et al.
2005/0082469 A1 4/2005 Carlo
2005/0092929 A1 5/2005 Schneiker
2005/0104684 A1 5/2005 Wojcik
2005/0105690 A1 5/2005 Pau et al.
2005/0145882 A1 7/2005 Taylor et al.
2005/0152635 A1 7/2005 Paddon et al.
2005/0162104 A1 7/2005 Victor et al.
2005/0190637 A1 9/2005 Ichimura et al.
2005/0194258 A1 9/2005 Cohen et al.
2005/0201707 A1 9/2005 Glebov et al.
2005/0201717 A1 9/2005 Matsumura et al.
2005/0212503 A1 9/2005 Deibele
2005/0231138 A1 10/2005 Nakanishi et al.
2005/0249451 A1 11/2005 Baehr-Jones et al.
2005/0285541 A1 12/2005 LeChevalier
2006/0007730 A1 1/2006 Nakamura et al.
2006/0018619 A1 1/2006 Helffrich et al.
2006/0035173 A1 2/2006 Davidson et al.
2006/0045418 A1 3/2006 Cho et al.
2006/0050269 A1 3/2006 Brownell
2006/0060782 A1 3/2006 Khursheed
2006/0062258 A1 3/2006 Brau et al.
2006/0131176 A1 6/2006 Hsu
2006/0131695 A1 6/2006 Kuekes et al.
2006/0159131 A1 7/2006 Liu et al.
2006/0164496 A1 7/2006 Tokutake et al.
2006/0187794 A1 8/2006 Harvey et al.
2006/0208667 A1 9/2006 Lys et al.
2006/0216940 A1 9/2006 Gorrell et al.
2006/0232364 A1 * 10/2006 Koh et al. ..... 333/227
2006/0243925 A1 11/2006 Barker et al.
2006/0274922 A1 12/2006 Ragsdale
2007/0003781 A1 1/2007 de Rochemont
2007/0013765 A1 1/2007 Hudson et al.
2007/0075263 A1 4/2007 Gorrell et al.
2007/0075264 A1 4/2007 Gorrell et al.
2007/0085039 A1 4/2007 Gorrell et al.
2007/0086915 A1 4/2007 LeBoeuf et al.
2007/0116420 A1 5/2007 Estes et al.
2007/0146704 A1 6/2007 Schmidt et al.
2007/0152176 A1 7/2007 Gorrell et al.
2007/0154846 A1 7/2007 Gorrell et al.
2007/0194357 A1 8/2007 Oohashi
2007/0200940 A1 8/2007 Gruhlke et al.
2007/0238037 A1 10/2007 Wuister et al.
2007/0252983 A1 11/2007 Tong et al.
2007/0258492 A1 11/2007 Gorrell
2007/0258689 A1 11/2007 Gorrell et al.
2007/0258690 A1 11/2007 Gorrell et al.

| | | | |
|---|---|---|---|
| 2007/0259641 | A1 | 11/2007 | Gorrell |
| 2007/0264023 | A1 | 11/2007 | Gorrell et al. |
| 2007/0264030 | A1 | 11/2007 | Gorrell et al. |
| 2007/0282030 | A1 | 12/2007 | Anderson et al. |
| 2007/0284527 | A1 | 12/2007 | Zani et al. |
| 2008/0069509 | A1 | 3/2008 | Gorrell et al. |
| 2008/0302963 | A1 | 12/2008 | Nakasuji et al. |

FOREIGN PATENT DOCUMENTS

| | | | |
|---|---|---|---|
| JP | 2004-32323 | A | 1/2004 |
| WO | WO 87/01873 | | 3/1987 |
| WO | WO 93/21663 | A1 | 10/1993 |
| WO | WO 00/72413 | | 11/2000 |
| WO | WO 02/25785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2005/098966 | | 10/2005 |
| WO | WO 2006/042239 | A2 | 4/2006 |
| WO | WO 2007/081389 | | 7/2007 |
| WO | WO 2007/081390 | | 7/2007 |
| WO | WO 2007/081391 | | 7/2007 |

OTHER PUBLICATIONS

"Antenna Arrays." May 18, 2002. www.tpub.com/content/neets/14183/css/14183_159.htm.

Alford, T.L. et al., "Advanced silver-based metallization patterning for ULSI applications," Microelectronic Engineering 55, 2001, pp. 383-388, Elsevier Science B.V.

Amato, Ivan, "An Everyman's Free-Electron Laser?" Science, New Series, Oct. 16, 1992, p. 401, vol. 258 No. 5081, American Association for the Advancement of Science.

Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.

Bakhtyari, A. et al., "Horn Resonator Boosts Miniature Free-Electron Laser Power," Applied Physics Letters, May 12, 2003, pp. 3150-3152, vol. 82, No. 19, American Institute of Physics.

Bhattacharjee, Sudeep et al., "Folded Waveguide Traveling-Wave Tube Sources for Terahertz Radiation." IEEE Transactions on Plasma Science, vol. 32. No. 3, Jun. 2004, pp. 1002-1014.

Brau, C.A. et al., "Gain and Coherent Radiation from a Smith-Purcell Free Electron Laser," Proceedings of the 2004 FEL Conference, pp. 278-281.

Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.

Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.

Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.

Chuang, S.L. et al., "Smith-Purcell Radiation from a Charge Moving Above a Penetrable Grating," IEEE MTT-S Digest, 1983, pp. 405-406, IEEE.

Far-IR, Sub-MM & MM Detector Technology Workshop list of manuscripts, session 6 2002.

Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.

Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.

Gallerano, G.P. et al., "Overview of Terahertz Radiation Sources," Proceedings of the 2004 FEL Conference, pp. 216-221.

Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.

Gover, A. et al., "Angular Radiation Pattern of Smith-Purcell Radiation," Journal of the Optical Society of America, Oct. 1984, pp. 723-728, vol. 1 No. 5, Optical Society of America.

Grishin, Yu. A. et al., "Pulsed Orotron—A New Microwave Source for Submillimeter Pulse High-Field Electron Paramagnetic Resonance Spectroscopy," Review of Scientific Instruments, Sep. 2004, pp. 2926-2936, vol. 75 No. 9, American Institute of Physics.

Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.

Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.

Ives, Lawrence et al., "Development of Backward Wave Oscillators for Terahertz Applications," Terahertz for Military and Security Applications, Proceedings of SPIE vol. 5070 (2003), pp. 71-82.

Ives, R. Lawrence, "IVEC Summary, Session 2, Sources I" 2002.

Jonietz, Erika, "Nano Antenna Gold nanospheres show path to all-optical computing," Technology Review, Dec. 2005/Jan. 2006, p. 32.

Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA Nov. 1995 pp. 117-121.

Joo, Youngcheol et al., "Fabrication of Monolithic Microchannels for IC Chip Cooling," 1995, Mechanical, Aerospace and Nuclear Engineering Department, University of California at Los Angeles.

Jung, K.B. et al., "Patterning of Cu, Co, Fe, and Ag for magnetic nanostructures," J. Vac. Sci. Technol. A 15(3), May/Jun. 1997, pp. 1780-1784.

Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.

Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.

Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.

Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.

Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.

Manohara, Harish et al., "Field Emission Testing of Carbon Nanotubes for THz Frequency Vacuum Microtube Sources." Abstract. Dec. 2003. from SPIEWeb.

McDaniel, James C. et al., "Smith-Purcell Radiation in the High Conductivity and Plasma Frequency Limits," Applied Optics, Nov. 15, 1989, pp. 4924-4929, vol. 28 No. 22, Optical Society of America.

Meyer, Stephan, "Far IR, Sub-MM & MM Detector Technology Workshop Summary," Oct. 2002. (may date the Manohara documents).

Mokhoff, Nicolas, "Optical-speed light detector promises fast space talk," EETimes Online, Mar. 20, 2006, from website: www.eetimes.com/showArticle.jhtml?articleID=183701047.

Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.

Nguyen, Phucanh et al., "Reactive ion etch of patterned and blanket silver thin films in Cl2/O2 and O2 glow discharges," J. Vac. Sci, Technol. B. 17 (5), Sep./Oct. 1999, American Vacuum Society, pp. 2204-2209.

Phototonics Research, "Surface-Plasmon-Enhanced Random Laser Demonstrated," Phototonics Spectra, Feb. 2005, pp. 112-113.

Potylitsin, A.P., "Resonant Diffraction Radiation and Smith-Purcell Effect," (Abstract), arXiv: physics/9803043 v2 Apr. 13, 1998.

Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1989, pp. 3267-3269, vol. 65 No. 8, American Institute of Physics.
Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7 No. 5, Optical Society of America.
Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7 No. 3, Optical Society of America.
Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.
Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.
Markoff, John, "A Chip That Can Transfer Data Using Laser Light," The New York Times, Sep. 18, 2006.
S.M. Sze, "Semiconductor Devices Physics and Technology", 2nd Edition, Chapters 9 and 12, Copyright 1985, 2002.
Search Report and Written Opinion mailed Feb. 12, 2007 in PCT Appln. No. PCT/US2006/022682.
Search Report and Written Opinion mailed Feb. 20, 2007 in PCT Appln. No. PCT/US2006/022676.
Search Report and Written Opinion mailed Feb. 20, 2007 in PCT Appln. No. PCT/US2006/022772.
Search Report and Written Opinion mailed Feb. 20, 2007 in PCT Appln. No. PCT/US2006/022780.
Search Report and Written Opinion mailed Feb. 21, 2007 in PCT Appln. No. PCT/US2006/022684.
Search Report and Written Opinion mailed Jan. 17, 2007 in PCT Appln. No. PCT/US2006/022777.
Search Report and Written Opinion mailed Jan. 23, 2007 in PCT Appln. No. PCT/US2006/022781.
Search Report and Written Opinion mailed Mar. 7, 2007 in PCT Appln. No. PCT/US2006/022775.
Thurn-Albrecht et al., "Ultrahigh-Density Nanowire Arrays Grown in Self-Assembled Diblock Copolymer Templates", Science 290. 5499, Dec. 15, 2000, pp. 2126-2129.
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Jun. 18, 2008 in PCT Appln. No. PCT/US2006/027430.
Search Report and Written Opinion mailed Jun. 3, 2008 in PCT Appln. No. PCT/US2006/022783.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
International Search Report and Written Opinion mailed Nov. 23, 2007 in International Application No. PCT/US2006/022786.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.
U.S. Appl. No. 11/418,082, filed May 5, 2006, Gorrell et al.
J. C. Palais, "Fiber optic communications," Prentice Hall, New Jersey, 1998, pp. 156-158.
Search Report and Written Opinion mailed Dec. 20, 2007 in PCT Appln. No. PCT/US2006/022771.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Mar. 11, 2008 in PCT Appln. No. PCT/US2006/022679.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.
Search Report and Written Opinion mailed Sep. 17, 2007 in PCT Appln. No. PCT/US2006/022689.
Mar. 24, 2006 PTO Office Action in U.S. Appl. No. 10/917,511.
Mar. 25, 2008 PTO Office Action in U.S. Appl. No. 11/411,131.
Apr. 8, 2008 PTO Office Action in U.S. Appl. No. 11/325,571.
Apr. 17, 2008 Response to PTO Office Action of Dec. 20, 2007 in U.S. Appl. No. 11/418,087.
Apr. 19, 2007 Response to PTO Office Action of Jan. 17, 2007 in U.S. Appl. No. 11/418,082.
May 10, 2005 PTO Office Action in U.S. Appl. No. 10/917,511.
May 21, 2007 PTO Office Action in U.S. Appl. No. 11/418,087.

May 26, 2006 Response to PTO Office Action of Mar. 24, 2006 in U.S. Appl. No. 10/917,511.
Jun. 16, 2008 Response to PTO Office Action of Dec. 14, 2007 in U.S. Appl. No. 11/418,264.
Jun. 20, 2008 Response to PTO Office Action of Mar. 25, 2008 in U.S. Appl. No. 11/411,131.
Aug. 14, 2006 PTO Office Action in U.S. Appl. No. 10/917,511.
Sep. 1, 2006 Response to PTO Office Action of Aug. 14, 2006 in U.S. Appl. No. 10/917,511.
Sep. 12, 2005 Response to PTO Office Action of May 10, 2005 in U.S. Appl. No. 10/917,511.
Sep. 14, 2007 PTO Office Action in U.S. Appl. No. 11/411,131.
Oct. 19, 2007 Response to PTO Office Action of May 21, 2007 in U.S. Appl. No. 11/418,087.
Dec. 4, 2006 PTO Office Action in U.S. Appl. No. 11/418,087.
Dec. 14, 2007 PTO Office Action in U.S. Appl. No. 11/418,264.
Dec. 14, 2007 Response to PTO Office Action of Sep. 14, 2007 in U.S. Appl. No. 11/411,131.
Dec. 20, 2007 PTO Office Action in U.S. Appl. No. 11/418,087.
European Search Report mailed Mar. 3, 2009 in European Application No. 06852028.7.
U.S. Appl. No. 11/203,407—Nov. 13, 2008 PTO Office Action.
U.S. Appl. No. 11/238,991—Dec. 6, 2006 PTO Office Action.
U.S. Appl. No. 11/238,991—Jun. 6, 2007 Response to PTO Office Action of Dec. 6, 2006.
U.S. Appl. No. 11/238,991—Sep. 10, 2007 PTO Office Action.
U.S. Appl. No. 11/238,991—Mar. 6, 2008 Response to PTO Office Action of Sep. 10, 2007.
U.S. Appl. No. 11/238,991— Jun. 27, 2008 PTO Office Action.
U.S. Appl. No. 11/238,991—Dec. 29, 2008 Response to PTO Office Action of Jun. 27, 2008.
U.S. Appl. No. 11/238,991—Mar. 24, 2009 PTO Office Action.
U.S. Appl. No. 11/243,477—Apr. 25, 2008 PTO Office Action.
U.S. Appl. No. 11/243,477—Oct. 24, 2008 Response to PTO Office Action of Apr. 25, 2008.
U.S. Appl. No. 11/243,477—Jan. 7, 2009 PTO Office Action.
U.S. Appl. No. 11/325,448—Jun. 16, 2008 PTO Office Action.
U.S. Appl. No. 11/325,448—Dec. 16, 2008 Response to PTO Office Action of Jun. 16, 2008.
U.S. Appl. No. 11/325,534—Jun. 11, 2008 PTO Office Action.
U.S. Appl. No. 11/325,534—Oct. 15, 2008 Response to PTO Office Action of Jun. 11, 2008.
U.S. Appl. No. 11/353,208—Jan. 15, 2008 PTO Office Action.
U.S. Appl. No. 11/353,208—Mar. 17, 2008 PTO Office Action.
U.S. Appl. No. 11/353,208—Sep. 15, 2008 Response to PTO Office Action of Mar. 17, 2008.
U.S. Appl. No. 11/353,208—Dec. 24, 2008 PTO Office Action.
U.S. Appl. No. 11/353,208—Dec. 30, 2008 Response to PTO Office Action of Dec. 24, 2008.
U.S. Appl. No. 11/400,280—Oct. 16, 2008 PTO Office Action.
U.S. Appl. No. 11/400,280—Oct. 24, 2008 Response to PTO Office Action of Oct. 16, 2008.
U.S. Appl. No. 11/410,905—Sep. 26, 2009 PTO Office Action.
U.S. Appl. No. 11/410,905—Mar. 26, 2009 Response to PTO Office Action of Sep. 26, 2008.
U.S. Appl. No. 11/410,924—Mar. 6, 2009 PTO Office Action.
U.S. Appl. No. 11/411,120—Mar. 19, 2009 PTO Office Action.
U.S. Appl. No. 11/411,129—Jan. 16, 2009 Office Action.
U.S. Appl. No. 11/411,130—May 1, 2008 PTO Office Action.
U.S. Appl. No. 11/411,130—Oct. 29, 2008 Response to PTO Office Action of May 1, 2008.
U.S. Appl. No. 11/417,129—Jul. 11, 2007 PTO Office Action.
U.S. Appl. No. 11/417,129—Dec. 17, 2007 Response to PTO Office Action of Jul. 11, 2007.
U.S. Appl. No. 11/417,129—Dec. 20, 2007 Response to PTO Office Action of Jul. 11, 2007.
U.S. Appl. No. 11/417,129—Apr. 17, 2008 PTO Office Action.
U.S. Appl. No. 11/417,129—Jun. 19, 2008 Response to PTO Office Action of Apr. 17, 2008.
U.S. Appl. No. 11/418,079—Apr. 11, 2008 PTO Office Action.
U.S. Appl. No. 11/418,079—Oct. 7, 2008 Response to PTO Office Action of Apr. 11, 2008.
U.S. Appl. No. 11/418,079—Feb. 12, 2009 PTO Office Action.
U.S. Appl. No. 11/418,080—Mar. 18, 2009 PTO Office Action.
U.S. Appl. No. 11/418,082—Jan. 17, 2007 PTO Office Action.
U.S. Appl. No. 11/418,083—Jun. 20, 2008 PTO Office Action.
U.S. Appl. No. 11/418,083—Dec. 18, 2008 Response to PTO Office Action of Jun. 20, 2008.
U.S. Appl. No. 11/418,084—Nov. 5, 2007 PTO Office Action.
U.S. Appl. No. 11/418,084—May 5, 2008 Response to PTO Office Action of Nov. 5, 2007.
U.S. Appl. No. 11/418,084—Aug. 19, 2008 PTO Office Action.
U.S. Appl. No. 11/418,084—Feb. 19, 2009 Response to PTO Office Action of Aug. 19, 2008.
U.S. Appl. No. 11/418,085—Aug. 10, 2007 PTO Office Action.
U.S. Appl. No. 11/418,085—Nov. 13, 2007 Response to PTO Office Action of Aug. 10, 2007.
U.S. Appl. No. 11/418,085—Feb. 12, 2008 PTO Office Action.
U.S. Appl. No. 11/418,085—Aug. 12, 2008 Response to PTO Office Action of Feb. 12, 2008.
U.S. Appl. No. 11/418,085—Sep. 16, 2008 PTO Office Action.
U.S. Appl. No. 11/418,085—Mar. 6, 2009 Response to PTO Office Action of Sep. 16, 2008.
U.S. Appl. No. 11/418,087—Dec. 29, 2006 Response to PTO Office Action of Dec. 4, 2006.
U.S. Appl. No. 11/418,087—Feb. 15, 2007 PTO Office Action.
U.S. Appl. No. 11/418,087—Mar. 6, 2007 Response to PTO Office Action of Feb. 15, 2007.
U.S. Appl. No. 11/418,088—Jun. 9, 2008 PTO Office Action.
U.S. Appl. No. 11/418,088—Dec. 8, 2008 Response to PTO Office Action of Jun. 9, 2008.
U.S. Appl. No. 11/418,089—Mar. 21, 2008 PTO Office Action.
U.S. Appl. No. 11/418,089—Jun. 23, 2008 Response to PTO Office Action of Mar. 21, 2008.
U.S. Appl. No. 11/418,089—Sep. 30, 2008 PTO Office Action.
U.S. Appl. No. 11/418,089—Mar. 30, 2009 Response to PTO Office Action of Sep. 30, 2008.
U.S. Appl. No. 11/418,091—Jul. 30, 2007 PTO Office Action.
U.S. Appl. No. 11/418,091—Nov. 27, 2007 Response to PTO Office Action of Jul. 30, 2007.
U.S. Appl. No. 11/418,091—Feb. 26, 2008 PTO Office Action.
U.S. Appl. No. 11/418,097—Jun. 2, 2008 PTO Office Action.
U.S. Appl. No. 11/418,097—Dec. 2, 2008 Response to PTO Office Action of Jun. 2, 2008.
U.S. Appl. No. 11/418,097—Feb. 18, 2009 PTO Office Action.
U.S. Appl. No. 11/418,099—Jun. 23, 2008 PTO Office Action.
U.S. Appl. No. 11/418,099—Dec. 23, 2008 Response to PTO Office Action of Jun. 23, 2008.
U.S. Appl. No. 11/418,100—Jan. 12, 2009 PTO Office Action.
U.S. Appl. No. 11/418,123—Apr. 25, 2008 PTO Office Action.
U.S. Appl. No. 11/418,123—Oct. 27, 2008 Response to PTO Office Action of Apr. 25, 2008.
U.S. Appl. No. 11/418,123—Jan. 26, 2009 PTO Office Action.
U.S. Appl. No. 11/418,124—Oct. 1, 2008 PTO Office Action.
U.S. Appl. No. 11/418,124—Feb. 2, 2009 Response to PTO Office Action of Oct. 1, 2008.
U.S. Appl. No. 11/418,124—Mar. 13, 2009 PTO Office Action.
U.S. Appl. No. 11/418,126—Oct. 12, 2006 PTO Office Action.
U.S. Appl. No. 11/418,126—Feb. 12, 2007 Response to PTO Office Action of Oct. 12, 2006 (REDACTED).
U.S. Appl. No. 11/418,126—Jun. 6, 2007 PTO Office Action.
U.S. Appl. No. 11/418,126—Aug. 6, 2007 Response to PTO Office Action of Jun. 6, 2007.
U.S. Appl. No. 11/418,126—Nov. 2, 2007 PTO Office Action.
U.S. Appl. No. 11/418,126—Feb. 22, 2008 Response to PTO Office Action of Nov. 2, 2007.
U.S. Appl. No. 11/418,126—Jun. 10, 2008 PTO Office Action.
U.S. Appl. No. 11/418,127—Apr. 2, 2009 Office Action.
U.S. Appl. No. 11/418,129—Dec. 16, 2008 Office Action.
U.S. Appl. No. 11/418,129—Dec. 31, 2008 Response to PTO Office Action of Dec. 16, 2008.
U.S. Appl. No. 11/418,244—Jul. 1, 2008 PTO Office Action.
U.S. Appl. No. 11/418,244—Nov. 25, 2008 Response to PTO Office Action of Jul. 1, 2008.
U.S. Appl. No. 11/418,263—Sep. 24, 2008 PTO Office Action.

U.S. Appl. No. 11/418,263—Dec. 24, 2008 Response to PTO Office Action of Sep. 24, 2008.
U.S. Appl. No. 11/418,263—Mar. 9, 2009 PTO Office Action.
U.S. Appl. No. 11/418,315—Mar. 31, 2008 PTO Office Action.
U.S. Appl. No. 11/418,318—Mar. 31, 2009 PTO Office Action.
U.S. Appl. No. 11/441,219—Jan. 7, 2009 PTO Office Action.
U.S. Appl. No. 11/522,929—Oct. 22, 2007 PTO Office Action.
U.S. Appl. No. 11/522,929—Feb. 21, 2008 Response to PTO Office Action of Oct. 22, 2007.
U.S. Appl. No. 11/641,678—Jul. 22, 2008 PTO Office Action.
U.S. Appl. No. 11/641,678—Jan. 22, 2009 Response to Office Action of Jul. 22, 2008.
U.S. Appl. No. 11/711,000—Mar. 6, 2009 PTO Office Action.
U.S. Appl. No. 11/716,552—Feb. 12, 2009 Response to PTO Office Action of Feb. 9, 2009.
U.S. Appl. No. 11/716,552—Jul. 3, 2009 PTO Office Action.
"Notice of Allowability" mailed on Jul. 2, 2009 in U.S. Appl. No. 11/410,905 filed Apr. 26, 2006.
"Notice of Allowability" mailed on Jun. 30, 2009 in U.S. Appl. No. 11/418,084 filed May 5, 2006.
B. B Loechel et al., "Fabrication of Magnetic Microstructures by Using Thick Layer Resists", Microelectronics Eng., vol. 21, pp. 463-466 (1993).
Magellan 8500 Scanner Product Reference Guide, PSC Inc., 2004, pp. 6-27-F18.
Magellan 9500 with SmartSentry Quick Reference Guide, PSC Inc., 2004.
Response to Non-Final Office Action submitted May 13, 2009 in U.S. Appl. No. 11/203,407.
U.S. Appl. No. 11/238,991—May 11, 2009 PTO Office Action.
U.S. Appl. No. 11/350,812—Apr. 17, 2009 Office Action.
U.S. Appl. No. 11/411,130—Jun. 23, 2009 PTO Office Action.
U.S. Appl. No. 11/418,089—Jul. 15, 2009 PTO Office Action.
U.S. Appl. No. 11/418,096—Jun. 23, 2009 PTO Office Action.
U.S. Appl. No. 11/433,486—Jun. 19, 2009 PTO Office Action.
Brau et al., "Tribute to John E Walsh", Nuclear Instruments and Methods in Physics Research Section A. Accelerators, Spectrometers, Detectors and Associated Equipment, vol. 475, Issues 1-3, Dec. 21, 2001, pp. xiii-xiv.
Kapp, et al., "Modification of a scanning electron microscope to produce Smith-Purcell radiation", Rev. Sci. Instrum. 75, 4732 (2004).
Scherer et al. "Photonic Crystals for Confining, Guiding, and Emitting Light", IEEE Transactions on Nanotechnology, vol. 1, No. 1, Mar. 2002, pp. 4-11.
U.S. Appl. No. 11/203,407—Jul. 17, 2009 PTO Office Action.
U.S. Appl. No. 11/418,123—Aug. 11, 2009 PTO Office Action.
U.S. Appl. No. 11/418,365—Jul. 23, 2009 PTO Office Action.
Urata et al., "Superradiant Smith-Purcell Emission", Phys. Rev. Lett. 80, 516-519 (1998).
"An Early History—Invention of the Klystron," http://varianinc.com/cgi-bin/advprint/print.cgi?cid=KLQNPPJJFJ, printed on Dec. 26, 2008.
"An Early History—The Founding of Varian Associates," http://varianinc.com/cgi-bin/advprint/print.cgi?cid=KLQNPPJJFJ, printed on Dec. 26, 2008.
"Chapter 3 E-Ray Tube," http://compepid.tuskegee.edu/syllabi/clinical/small/radiology/chapter..., printed from tuskegee.edu on Dec. 29, 2008.
"Diagnostic imaging modalities—Ionizing vs non-ionizing radiation," http://info.med.yale.edu/intmed/cardio/imaging/techniques/ionizing_v..., printed from Yale University School of Medicine on Dec. 29, 2008.
"Frequently Asked Questions," Luxtera Inc., found at http://www.luxtera.com/technology_faq.htm, printed on Dec. 2, 2005, 4 pages.
"Klystron Amplifier," http://www.radartutorial.eu/08.transmitters/tx12.en.html, printed on Dec. 26, 2008.
"Klystron is a Micowave Generator," http://www2.slac.stanford.edu/vvc/accelerators/klystron.html, printed on Dec. 26, 2008.
"Klystron," http:en.wikipedia.org/wiki/Klystron, printed on Dec. 26, 2008.
"Making E-rays," http://www.fnrfscience.cmu.ac.th/theory/radiation/xray-basics.html, printed on Dec. 29, 2008.
"Microwave Tubes," http://www.tpub.com/neets/book11/45b.htm, printed on Dec. 26, 2008.
"Notice of Allowability" mailed on Jan. 17, 2008 in U.S. Appl. No. 11/418,082, filed May 5, 2006.
"Technology Overview," Luxtera, Inc., found at http://www.luxtera.com/technology.htm, printed on Dec. 2, 2005, 1 page.
"The Reflex Klystron," http://www.fnrfscience.cmu.ac.th/theory/microwave/microwave%2, printed from Fast Netoron Research Facilty on Dec. 26, 2008.
"x-ray tube," http://www.answers.com/topic/x-ray-tube, printed on Dec. 29, 2008.
Corcoran, Elizabeth, "Ride the Light," Forbes Magazine, Apr. 11, 2005, pp. 68-70.
Neo et al., "Smith-Purcell Radiation from Ultraviolet to Infrared Using a Si-field Emitter" Vacuum Electronics Conference, 2007, IVEC '07, IEEE International May 2007.
Ossia, Babak, "The X-Ray Production," Department of Biomedical Engineering—University of Rhode Island, 1 page.
Sadwick, Larry et al., "Microfabricated next-generation millimeter-wave power amplifiers," www.rfdesign.com.
Saraph, Girish P. et al., "Design of a Single-Stage Depressed Collector for High-Power, Pulsed Gyroklystrom Amplifiers," IEEE Transactions on Electron Devices, vol. 45, No. 4, Apr. 1998, pp. 986-990.
Sartori, Gabriele, "CMOS Photonics Platform," Luxtera, Inc., Nov. 2005, 19 pages.
Search Report and Writen Opinion mailed Jul. 14, 2008 in PCT Appln. No. PCT/US2006/022773.
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Aug. 19, 2008 in PCT Appln. No. PCT/US2007/008363.
Search Report and Written Opinion mailed Jul. 16, 2008 in PCT Appln. No. PCT/US2006/022766.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Jun. 18, 2008 in PCT Appln. No. PCT/US2006/027430.
Search Report and Written Opinion mailed Jun. 3, 2008 in PCT Appln. No. PCT/US2006/022783.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
Search Report and Written Opinion mailed Sep. 2, 2008 in PCT Appln. No. PCT/US2006/022769.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.
Thumm, Manfred, "Historical German Contributions to Physics and Applications of Electromagnetic Oscillations and Waves."
Whiteside, Andy et al., "Dramatic Power Savings using Depressed Collector IOT Transmitters in Digital and Analog Service."
U.S. Appl. No. 11/418,097—Sep. 16, 2009 PTO Office Action.
U.S. Appl. No. 11/441,240—Aug. 31, 2009 PTO Office Action.

* cited by examiner

COUPLING A SIGNAL THROUGH A WINDOW

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

CROSS-REFERENCE TO RELATED APPLICATIONS

The present invention is related to the following co-pending U.S. patent applications which are all commonly owned with the present application, the entire contents of each of which are incorporated herein by reference:

1. U.S. patent application Ser. No. 11/238,991, entitled "Ultra-Small Resonating Charged Particle Beam Modulator," filed Sep. 30, 2005;
2. U.S. patent application Ser. No. 10/917,511, entitled "Patterning Thin Metal Film by Dry Reactive Ion Etching," filed on Aug. 13, 2004;
3. U.S. application Ser. No. 11/203,407, entitled "Method Of Patterning Ultra-Small Structures," filed on Aug. 15, 2005;
4. U.S. application Ser. No. 11/243,476, entitled "Structures And Methods For Coupling Energy From An Electromagnetic Wave," filed on Oct. 5, 2005;
5. U.S. application Ser. No. 11/243,477, entitled "Electron beam induced resonance," filed on Oct. 5, 2005;
6. U.S. application Ser. No. 11/325,448, entitled "Selectable Frequency Light Emitter from Single Metal Layer," filed Jan. 5, 2006;
7. U.S. application Ser. No. 11/325,432, entitled, "Matrix Array Display," filed Jan. 5, 2006;
8. U.S. application Ser. No. 11/302,471, entitled "Coupled Nano-Resonating Energy Emitting Structures," filed Dec. 14, 2005;
9. U.S. application Ser. No. 11/325,571, entitled "Switching Micro-resonant Structures by Modulating a Beam of Charged Particles," filed Jan. 5, 2006;
10. U.S. application Ser. No. 11/325,534, entitled "Switching Microresonant Structures Using at Least One Director," filed Jan. 5, 2006;
11. U.S. application Ser. No. 11/350,812, entitled "Conductive Polymers for Electroplating," filed Feb. 10, 2006;
12. U.S. application Ser. No. 11/349,963, entitled "Method and Structure for Coupling Two Microcircuits," filed Feb. 9, 2006; and
13. U.S. application Ser. No. 11/353,208, entitled "Electron Beam Induced Resonance," filed Feb. 14, 2006.

FIELD OF THE DISCLOSURE

This relates in general to receivers for detecting optical signals and in particular to resonant structures detecting encoded optical signals.

INTRODUCTION

The present device relates in general to coupling a signal in a vacuum environment and, more particularly, to coupling a signal through a window.

A device can be formed from a wall disposed on a substrate. The wall can be generally formed or enclosed about a space, which is referred to as a cavity. The cavity or resonant cavity can be used to perform various functions on a signal including mixing, amplifying, filtering and the like. The cavity can be represented by a parallel resonant LC circuit. The size of the cavity generally determines the resonant frequency. The cavity typically comprises a center portion and an outer portion, which is adjacent to the wall. Normally, the center portion is capacitive, and the outer portion is inductive. The signal within the resonant cavity can take the form of electric and magnetic fields. The signal is made up of oscillations and variation in those oscillations of the electric and magnetic fields. The outer portion is normally adjacent to the wall, and the electric fields can induce current on the wall of the cavity. This current on the wall is typically referred to as surface current. In response to the surface current or moving charges on the wall of the cavity, magnetic fields are normally formed inside of the current loop made by the charge moving along the wall of the cavity.

The device can include a plurality of walls forming distinct cavities. The various functions of such cavities, such as amplifying, can be performed by coupling the signal between cavities. For example, a feedback signal from a first cavity can control the amount of amplification in a second cavity. Methods of coupling the signal can include using a loop, a probe, a port or a tap. The loop couples the signal by employing a single loop of wire or a portion of wire through the wall of the device and into the cavity attached to the wall of the cavity in such a way that the oscillating magnetic field in the cavity has some magnetic flux through the loop. This generates a current in the loop proportional to the oscillating magnetic field. For the best coupling, the loop is typically attached to the wall at one end and positioned transverse to the strongest magnetic field. Another method such as the probe can include a single plate, which is not grounded. For best results, the plate is typically positioned transverse to the strongest electric field near the center portion of the cavity. The probe can be mechanically difficult to support, because the connection to the plate is on one end only. Further, arcing can occur where the electric field is the strongest. The port is another mentioned technique for coupling the signal and exposes the cavity via an opening in the wall. The amount of coupling is a function of the size of the port relative to the wavelength of the radiation and the position of the port. Tap coupling includes a direct connection to the cavity. All the mentioned techniques for coupling the signal generally disrupt the surface current, because of the inherent discontinuity of the inner surface of the wall to physically connect the loop, tap and probe. In the case of the port, the wall includes the opening, which disrupts the surface current. The discontinuity or gap can cause the surface current to radiate. This radiation typically generates spurious frequencies different from the cavity resonant frequency. The ratio of the energy of the signal stored in the cavity divided by the energy of the signal dissipated in the cavity is referred to as the Q of the cavity. All of the mentioned coupling techniques generally increase the energy losses within the cavity or reduce the Q of the cavity. For example, the penetrations through the wall of the cavity reduce the available path for currents flowing on the inner surface of the cavity. This increases the losses of the signal and reduces the available energy of the signal stored within the cavity.

Hence, there is a need for a device that can couple signals between cavities without the losses inherent with the mentioned coupling methods. We describe such a device in which a resonant cavity includes a wall with a corridor for coupling the signal.

DETAILED DESCRIPTION OF THE DRAWINGS

Figure 1:
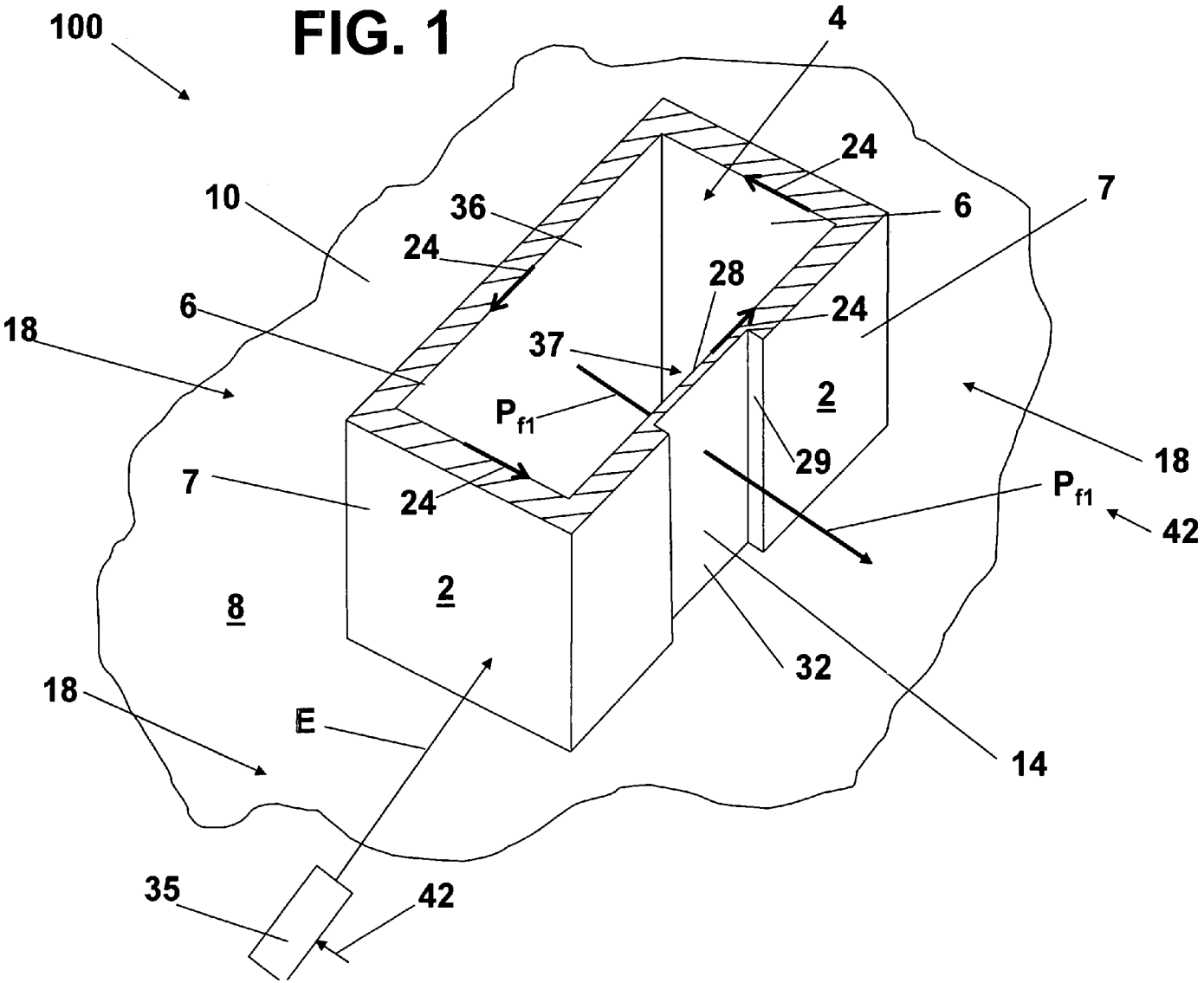
FIG. 1 is an enlarged topped-off perspective-view of a coupling device.

Methods of making a device for detecting an electromagnetic wave are described in U.S. application Ser. No. 10/917,511, filed on Aug. 13, 2004, entitled "Patterning Thin Metal Film by Dry Reactive Ion Etching," and U.S. application Ser. No. 11/203,407, filed Aug. 15, 2005, entitled "Method of Patterning Ultra-small Structures," each of which is commonly owned at the time of filing, and the entire contents of each are incorporated herein by reference.

Using these techniques, a structure for coupling a signal to and from a cavity of a device can be manufactured, as described for example in one or more of the following applications, each of which are incorporated by reference:

14. U.S. patent application Ser. No. 11/238,991, entitled "Ultra-Small Resonating Charged Particle Beam Modulator," filed Sep. 30, 2005;
15. U.S. application Ser. No. 11/243,476, entitled "Structures And Methods For Coupling Energy From An Electromagnetic Wave," filed on Oct. 5, 2005;
16. U.S. application Ser. No. 11/243,477, entitled "Electron beam induced resonance," filed on Oct. 5, 2005;
17. U.S. application Ser. No. 11/325,448, entitled "Selectable Frequency Light Emitter from Single Metal Layer," filed Jan. 5, 2006;
18. U.S. application Ser. No. 11/325,432, entitled, "Matrix Array Display," filed Jan. 5, 2006;
19. U.S. application Ser. No. 11/302,471, entitled "Coupled Nano-Resonating Energy Emitting Structures," filed Dec. 14, 2005;
20. U.S. application Ser. No. 11/325,571, entitled "Switching Micro-resonant Structures by Modulating a Beam of Charged Particles," filed Jan. 5, 2006;
21. U.S. application Ser. No. 11/325,534, entitled "Switching Microresonant Structures Using at Least One Director," filed Jan. 5, 2006;
22. U.S. application Ser. No. 11/350,812, entitled "Conductive Polymers for Electroplating," filed Feb. 10, 2006;
23. U.S. application Ser. No. 11/349,963, entitled "Method and Structure for Coupling Two Microcircuits," filed Feb. 9, 2006;
24. U.S. application Ser. No. 11/353,208, entitled "Electron Beam Induced Resonance," filed Feb. 14, 2006; and
25. U.S. application Ser. No. 11/400,280, entitled "Resonant Detector for Optical Signals," filed Apr. 10, 2006.

Such a device can include a microstructure formed by a wall. The wall can be formed by stacking layers of material on a surface and can form a substantially closed geometric configuration that defines or encloses the cavity. An electrically conductive window or plurality of windows can be formed in the wall. An electromagnetic wave either generated within the cavity or provided from an outside source can be coupled in and out of the cavity through the window. The outside source can include another location within the device. The electromagnetic wave can carry a signal and have a frequency range from about 0.1 terahertz (THz) (3000 microns) to about 7 petahertz (PHz) (0.4 nanometers), referred to as the terahertz portion of the electromagnetic spectrum. Under such an influence, surface current typically forms on an inner surface of the cavity. Unlike other coupling methods, the window, which is electrically conductive, allows conduction of the surface current. This provides the advantage of not disrupting the surface current and the resonance of the cavity.

In an alternate embodiment, a device can include a focusing element coupled to the window. The focusing element collects the electromagnetic wave carrying the signal. Further, a waveguide or an optical fiber can be coupled to the focusing element and can be used to route the signal to a particular location.

In another alternate embodiment, a device can include at least two walls or microstructures and each microstructure can contain at least one window. A waveguide or optical fiber can be used to couple a feedback signal between the windows.

In yet another alternate embodiment, a device can include a window that filters particular frequency ranges of the electromagnetic wave carrying the signal. The filtering can include limiting frequencies above or below a particular critical frequency.

The present invention will be better understood from a reading of the following detailed description, taken in conjunction with the accompanying drawing figures, in which like reference numbers designate like elements and in which:

FIG. 1 is an enlarged topped-off, perspective view illustrating a coupling device 100. In FIG. 1, the device 100 comprises a wall 2. The wall 2 can include a microstructure or a portion of a microcircuit and can be formed by stacking layers of material on a surface 10 of a substrate 8. The surface can be flat as in FIG. 1, or may be any other flat or non-flat wall-shaped configuration. The surface can be on a substrate or other structure and may be in unusual locations, such as on fiber ends or on filaments. The number of layers of the wall 2 and method of forming the wall 2 should not be considered limitations of the present invention. The wall 2 can form a substantially closed geometric configuration that defines or encloses or partially encloses a cavity 4. The substrate 8 can include all or a portion of a microcircuit made of semiconductor materials, ceramics, plastics, metals and the like. Even though the device 100 is shown generally cubical with the wall 2 straight, the device 100 can include a shape that is spherical, c-shaped, triangular-pyramidal or other shape that has the desired resonant frequency characteristics. The shape should not be considered a limitation of the present invention. The device 100 and the cavity 4 can be sized to the resonant wavelength, sub-wavelength, and multiples of the operating wavelength.

The wall 2 can be made of a material having a strong interaction with plasmons at the frequency of operation of the device 100. Plasmons can include bulk plasmons and surface plasmons, which are plasma oscillations or charge density waves. Surface plasmons refer to those charge density waves confined to an interface of a material with sufficiently free electrons and a dissimilar material. This strong interaction can include using metals having a plasma frequency covering at least a portion of the optical and/or terahertz spectrum, depending on the application frequency. The plasma frequency is dependant upon the type of material used. For example, the plasma frequency of silver includes a range from the visible portion of the electromagnetic spectrum to the infrared. Hence, there is a strong interaction between silver and an electromagnetic wave within the above frequency range. The wall 2 can be made using materials such as gold, silver, copper, aluminum and the like.

An outer surface 7 of the device 100 or the wall 2 can be exposed to a space 18, such as a vacuum or a gas or a solid dielectric. As shown, energy (E as shown in FIG. 1) such as an electromagnetic wave can be provided from an outside source 35. The outside source 35 can include another portion of the device as discussed later under FIG. 9. The energy (E) can be coupled across the space 18 to the outer surface 7. This provides a permittivity or dielectric shift of the energy, (E) because of the transition across the space 18 to the outer surface 7, which typically comprises a metal. A plasmon mode or a stimulation of the plasmons is caused by an interaction between the energy (E) and free-electrons on the outer surface 7. This results in a plasmon mode or a stimulation of the plasmons on the outer surface 7 of the wall 2. In some cases, particularly at lower frequencies, the Plasmon mode is not active and the charge transport occurs by more typical conduction mechanisms. Varying fields inherently occur on stimulation of the plasmons or other charge density fluctuations. Further, a signal 42 coupled to the outside source 35 can be carried on the energy (E) or electromagnetic wave coupled to the device 100. The remainder of the discussion will refer to Plasmon waves, but it is to be understood that the effects are also applicable to the more general case of charge density waves.

An inner surface 6 is the side of the wall 2 exposed to the cavity 4. Plasmons having varying fields are stimulated on the outer surface 7 and can be coupled through the wall 2 to the inner surface 6. The energy from the varying fields can be stored in the cavity 4 or intensified if another source of energy is provided. Electric and magnetic fields are generated within the cavity 4. This can result in accelerating charges on the inner surface 6 of the cavity 4. Further, the varying fields can include a time-varying electric field component across the cavity 4. Thus, similar to an antenna, an electromagnetic wave $P_{f1}$ can be generated in the cavity 4. Further, the magnetic fields within the cavity 4 excite a surface current 24 on the inner surface 6 of the device 100.

In FIG. 1, a window 14 is shown formed in the wall 2 of the device 100. The window 2 is electrically conductive or made of a material that supports the necessary charge density wave and may be made from the wall 2. The window 14 and the wall 2 are illustrated by the topped-off view in FIG. 1 as having distinctive thicknesses. The thickness of the window 14 is typically substantially less than the thickness of the wall 2. In one example, the thickness of the window 14 is less than 10 nanometers. In another example, the thickness of the window 14 can be less than the penetration depth (δ). For a time-varying current, the current density through a conductor varies exponentially as a function of a depth into the conductor. By convention, a penetration depth (δ) is defined as the depth where the current density is 36.78 percent (1/ε or one divided by 2.7182) of the current density at the surface of the conductor. The penetration depth can be calculated by:

$$\delta = \frac{1}{\sqrt{\pi f \mu \sigma}} \qquad \text{Equation 1}$$

The variables of equation 1 include f, σ and μ, which are the frequency of the time-varying current, the conductivity of the conductor, and the permeability of the conductor, respectively. For example, the penetration depth (δ) for copper at a frequency of 1 terahertz is about 66 nanometers.

The window 14 can be made to allow the electromagnetic wave $P_{f1}$ to partially pass through. This permits coupling of the electromagnetic wave $P_{f1}$ in or out of the cavity 4 through the window 14. The window 14 can have a thickness less than, greater than, or equal to the penetration depth (δ). Generally, the window 14 can pass the electromagnetic wave $P_{f1}$ with reflection or absorption of less than a few percent and can be referred to as generally transparent. In another embodiment, the window 14 can partially reflect or absorb the electromagnetic wave $P_{f1}$ and can be called translucent. It should be noted that the amount of scattering through the window 14 can be a function of the type of material and/or processing used to make the window 14. Further, the transmittance is dependant upon the thickness of the window 14 and the wavelength of the electromagnetic wave $P_{f1}$. For example, the window 14 made of silver and having a thickness of about 10 nanometers has a transmittance of about 95 percent in the visible portion of the electromagnetic spectrum. Further yet, the window 14 can be made to pass particular frequencies. For example, the window 14 can function as a low-pass, high-pass, band-pass or band-stop filter. The thickness of the window 14 in combination with the type of material used to make the window 14 can establish a particular range of frequencies passed by the window 14. The transmittance of the window 14 can include a range from about zero percent to about 99.9 percent.

A surface or portion of the window 14 is exposed to or adjacent to the cavity 4. This portion of the window 14 adjacent to the cavity 4 can include the entire inner surface 6 and is referred to as a portion of the inner surface 28. The portion of the inner surface 28 of the window 14 can be generally flush with the inner surface 6 of the cavity 4. As mentioned above, surface current 24 is induced on the inner surface 6 by varying electric and magnetic fields. When disrupted by a discontinuity or gap, the surface current 24 generates spurious radiation. Since there is no discontinuity between the portion of the inner surface 28 and the inner surface 6, the surface current 24 does not radiate. This provides a distinct advantage over the prior art.

An area 36 includes the entire inner surface 6. An area 37 includes the portion of the inner surface 28. The area 37 includes between about 1 percent to about 100 percent of the area 36.

A step 29 can be formed on the outer surface 7. A portion of the outer surface 7 that forms the window 14 is called an outside surface 32. The step 29 can be formed between the outside surface 32 and the outer surface 7. The step 29 can be abrupt or can taper or form a graded transition between the outside surface 32 and the outer surface 7.

Figure 2A:
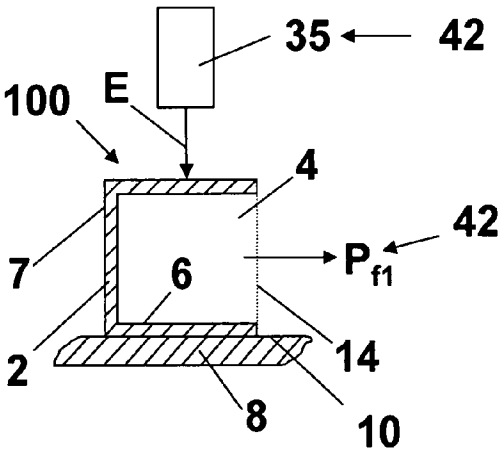
FIG. 2*a* is a schematic diagram of the device in FIG. 1 illustrating energy transferred into the device and an electromagnetic wave transferred out of the device.
Figure 2B:
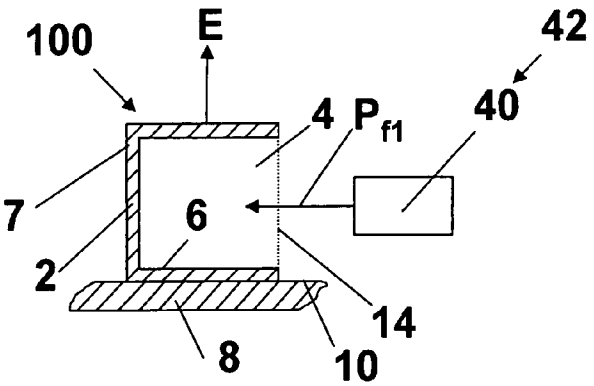
FIG. 2*b* is a schematic diagram of the device in FIG. 1 illustrating the electromagnetic wave transferred to the device and the energy transferred out of the device.
Figure 2C:
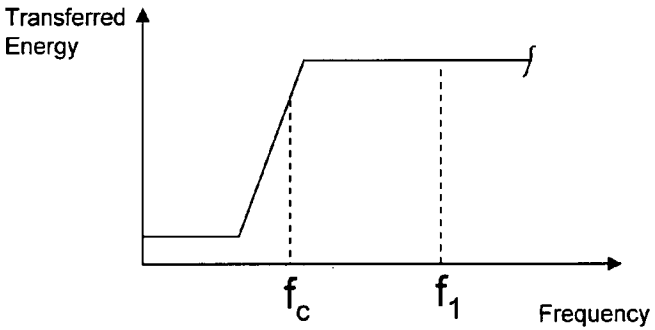
FIG. 2*c* and is schematic diagram of the device of FIG. 1 illustrating the frequency response of a window of the device.

FIGS. 2*a* and 2*b* are schematic diagrams illustrating the device 100 formed from the wall 2 that defines or encloses the cavity 4. In FIGS. 2*a* and 2*b*, plasmons are stimulated at the outer 7 and inner 6 surfaces of the wall 2, respectively. In FIG. 2*a*, energy (E) is provided to the outer surface 7 by the outside source 35. Plasmons and varying fields are stimulated on the outer surface 7. The energy (E) is represented by an arrow pointing toward the device 100 and can be modulated to carry the signal 42. The net flow of energy (E) including stimulated plasmons and varying fields are coupled through the wall 2 from the outer 7 to the inner 6 surface. An electromagnetic wave $P_{f1}$ is generated in the cavity 4. The electromagnetic wave $P_{f1}$ can include frequencies distributed over a range of frequencies centered about a frequency f1. As shown in FIG. 2*c*, the window 14 can be made to pass frequencies above a particular critical frequency $f_c$ including frequency $f_1$ of the electromagnetic wave $P_{f1}$. This allows the electromagnetic wave $P_{f1}$ carrying the signal 42 to couple out of the device 100 through the window 14. In FIG. 2*b*, the electromagnetic wave $P_{f1}$, now provided from an outside source 40 modulated by the signal 42, is coupled through the window 14 and into the cavity 4 of the device 100. Plasmons are stimulated on the inner surface 6. The energy (E) in the form of plasmons and varying fields can be coupled through the wall 2 from the inner 6 to the outer 7 surface. Since the net flow of energy (E) is from the inner surface 6, the arrow in FIG. 2*b* is now shown pointing away from the device 100.

Figure 3:
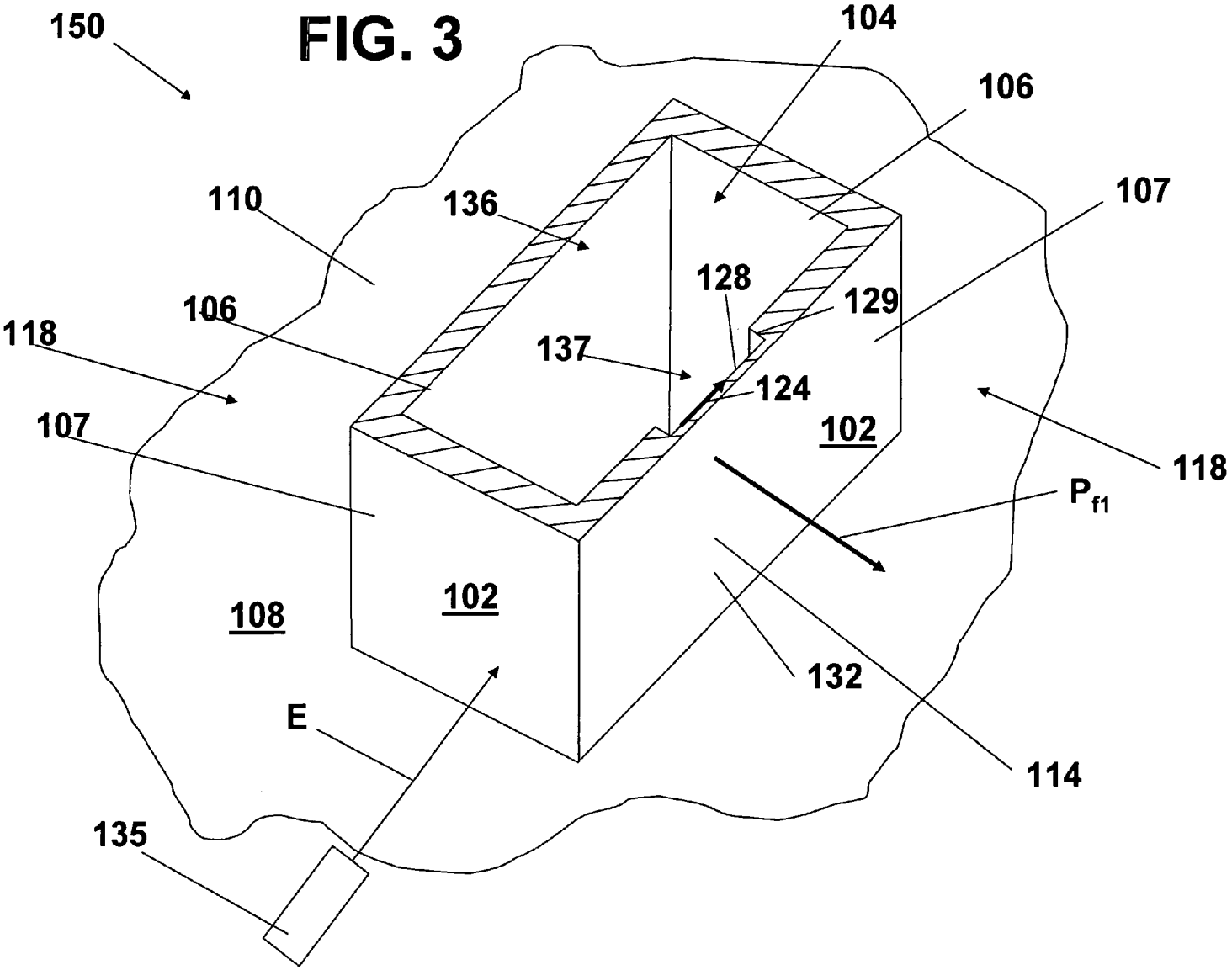
FIG. 3 is an enlarged topped-off perspective-view of an alternative coupling device.

FIG. 3 is an enlarged topped-off, perspective view showing a coupling device 150. FIG. 3 illustrates a wall 102 disposed on a major surface 110 of a substrate 108, and the wall 102 is formed about a cavity 104. An inner surface 106 of the wall 102 is exposed to the cavity 104. A window 114 is formed in the wall 102 and as shown has a thickness generally less than the thickness of the wall 102. A surface or portion of the window 114 is exposed to or adjacent to the cavity 104. This portion of the window 114 can include the entire inner surface 106 and is referred to as a portion of the inner surface 128. In this embodiment, a step 129 is included on the inner surface 106 between the portion of the inner surface 128 and the inner surface 106. The step 129 can be abrupt or can taper or form a graded transition between the portion of inner surface 128 and the inner surface 106.

Figure 4A:
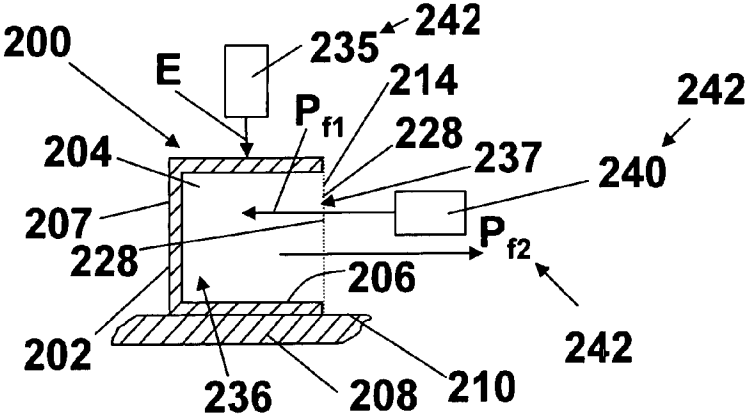
FIG. 4*a* is a schematic diagram illustrating energy coupled into a device and electromagnetic waves transferred in and out of the device.
Figure 4C:
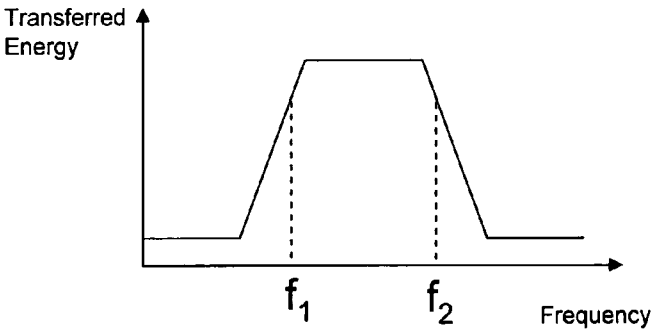
FIG. 4*c* and is schematic diagram of the device of FIGS. 4*a* and 4*b* illustrating the response of a window.
Figure 4B:
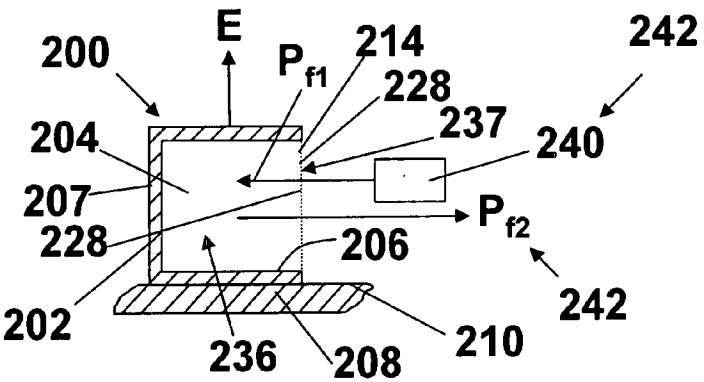
FIG. 4*b* is a schematic diagram illustrating the electromagnetic waves transferred in and out of the device and the energy coupled out of the device.

FIGS. 4*a* and 4*b* are schematic diagrams illustrating the device 200 formed from the wall 202 that defines or encloses the cavity 204. In FIGS. 4*a* and 4*b*, plasmons are stimulated at the outer 207 and inner 206 surfaces of the wall 202, respectively. In FIG. 4*a*, energy (E) is provided to the outer surface 207 by an outside source 235. The outside source 235 can include another portion of the device as discussed later under FIG. 9. The energy (E) can be modulated by a signal 242 coupled to the outside source 235. Plasmons and varying fields are stimulated on the outer surface 207. The energy (E) is represented by an arrow pointing toward the device 200. This is because the net flow of energy (E) including stimulated plasmons and varying fields are coupled through the wall 202 from the outer 207 to the inner 206 surface. Also, an electromagnetic wave $P_{f1}$ is received through a window 214 into the cavity 204 from an outside source 240. The outside source 240 can include another portion of the device 200. The energy (E) can be modulated by a signal 242 coupled to the outside source 240. The window 214 is electrically conductive and made from the wall 202. The electromagnetic wave $P_{f1}$ carrying the signal 242 can include frequencies distributed over a range of frequencies centered about a frequency f1. The electromagnetic wave $P_{f1}$ further stimulates plasmons and varying fields on the inner surface 206. An electromagnetic wave $P_{f2}$ having frequencies distributed over a range of frequencies centered about a frequency f2 is generated in the cavity 204 from the stimulated plasmons and varying fields on the inner surface 206. The electromagnetic wave $P_{f2}$ carrying the signal 242 is coupled through the window 214 and out of the cavity 204. As shown in FIG. 4*c*, the window 214 is made to pass frequencies over a range of frequencies including $f_1$ and $f_2$. This allows the electromagnetic waves $P_{f1}$ and $P_{f2}$ to pass through or couple through the window 214 and into and out of the cavity 204, respectively. In FIG. 4*b*, the electromagnetic wave $P_{f1}$ carrying the signal 242 is again received through the window 214 into the cavity 204 from the outside source 240. Plasmons and varying fields are stimulated on the inner surface 206. As shown in FIG. 4*b*, an arrow (E) is pointing away from the device 200, because the net flow of energy (E) is through the wall 202 from the inner 206 to the outer 207 surface.

Figure 5:
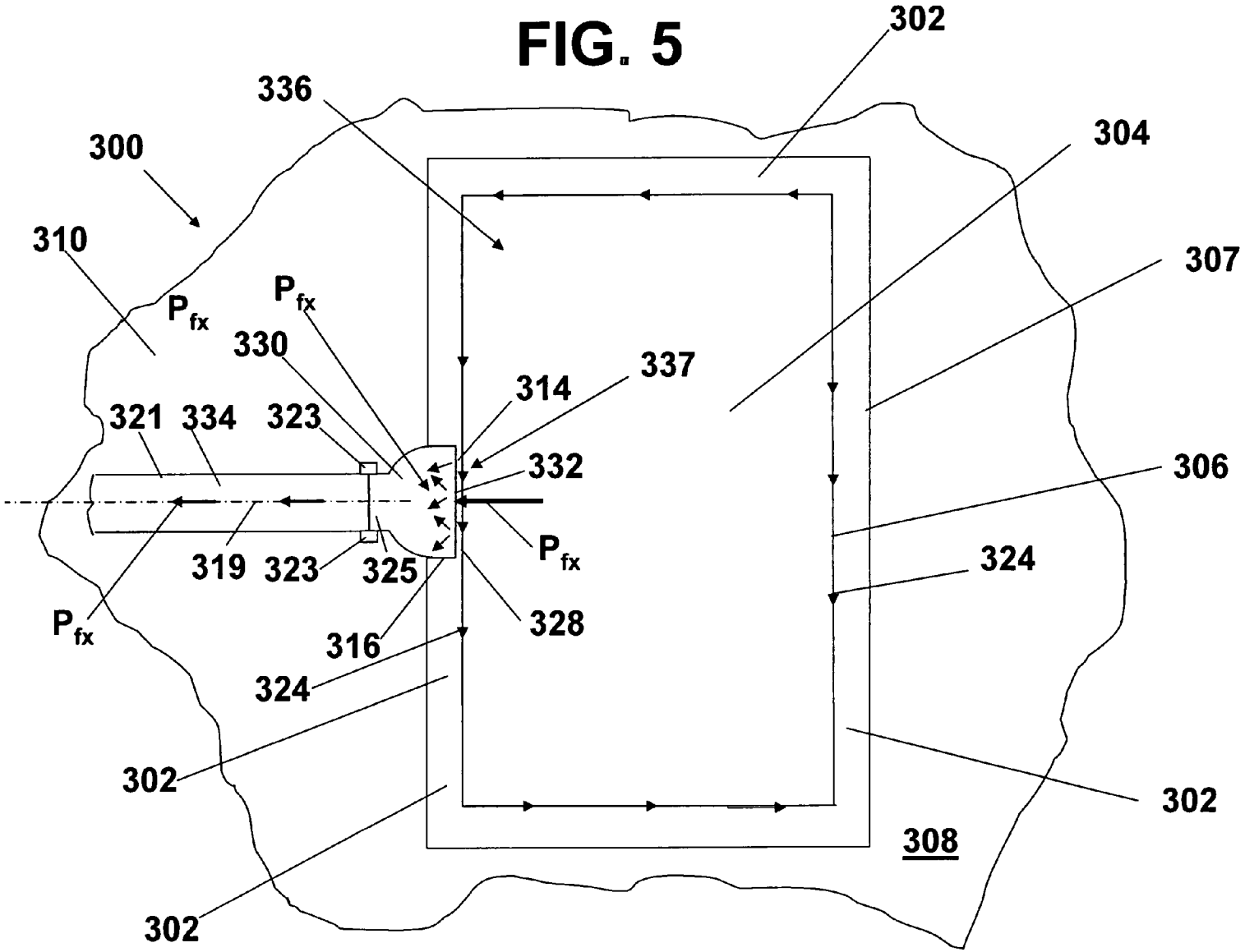
FIG. 5 is an enlarged cross-sectional top-view illustrating the coupling of an electromagnetic wave through a window and out of a device.

FIG. 5 is an enlarged cross sectional top-view illustrating another alternative coupling device 300. The device 300 includes a wall 302 formed on a surface 310 of a substrate 308. The wall 302 includes inner 306 and outer 307 surfaces and is formed about a cavity 304. The inner surface 306 is exposed to the cavity 304.

A window 314 is formed in the wall 302 similar to FIG. 1. The window 314 is electrically conductive and made from the wall 302. The window 314 is generally thinner than a portion of the wall 302 not containing the window 314. A surface or portion of the window 314 is exposed to or adjacent to the cavity 304. This portion of the window 314 adjacent to the cavity 304 can include the entire inner surface 306 and is called a portion of the inner surface 328. The surface of the window 314 opposite the portion of the inner surface 328 is referred to as the outside surface 332. As mentioned previously under FIG. 1, surface current 324 can be induced by magnetic fields on the inner surface 306. Similar to FIG. 1, the inner surface 306 and the portion of the inner surface 328 are generally flush and provide a continuous path without disrupting the path of the surface current 324.

An indentation 316 can be formed on the outer surface 307 and can include the outside surface 332 of the window 314. As shown in FIG. 5, an electromagnetic wave $P_{fx}$ passes or couples through the window 314 and out of the cavity 304. The path of the electromagnetic wave $P_{fx}$ can be scattered or travel on a plurality of paths including paths nearly parallel to the outside surface 332 of the window 314.

A collector 330 can be positioned to fill the indentation 316 and may contact the outside surface 332 of the window 314. The collector 330 reduces the scatter or alters the plurality of paths such that the electromagnetic wave $P_{fx}$ travels generally parallel to a centerline 319 shown in FIG. 5 extending from the collector 330. As shown in FIG. 5, the collector 330 can include a protruding portion 325 to connect to other structures and can include a collimator (not shown). The collector 330 can be made using materials including plastic, glass and the like or could be a waveguide type structure. The collector 330 can be made using materials having a combination of refractive indexes for directing the electromagnetic wave $P_{fx}$ along a path generally parallel to the centerline 319. Further, the collector 330 can include a layer (not shown) or a plurality of layers of alternating refractive indexes to limit reflections. The layer(s) can be formed using chemical vapor deposition, which is well known in the art.

A wave coupler 334 can be connected to the collector 332 and is used to couple the electromagnetic wave $P_{fx}$ from the collector 330. The wave coupler 334 can be formed to the collector 330 using established semiconductor processing methods. In another embodiment (as shown), a ferrule 323 can be used to align and couple between the protruding portion 325 of the collector 330 and the wave coupler 334. The technique for coupling the collector 330 to the wave coupler 334 should not be considered a limitation to the present invention. The wave coupler 334 can include a dielectric waveguide made of a dielectric material or multiple layers of materials. The dielectric materials can include plastic, glass, various gasses such as air and the like. Further, the wave coupler 334 can include a hollow silica waveguide. For frequencies in the infrared portion of the electromagnetic spectrum, an inside wall 321 of the wave coupler 334 can include silver in combination with a dielectric reflector. The type of construction of the wave coupler 334 should not be considered a limitation of the present invention.

Figure 6:
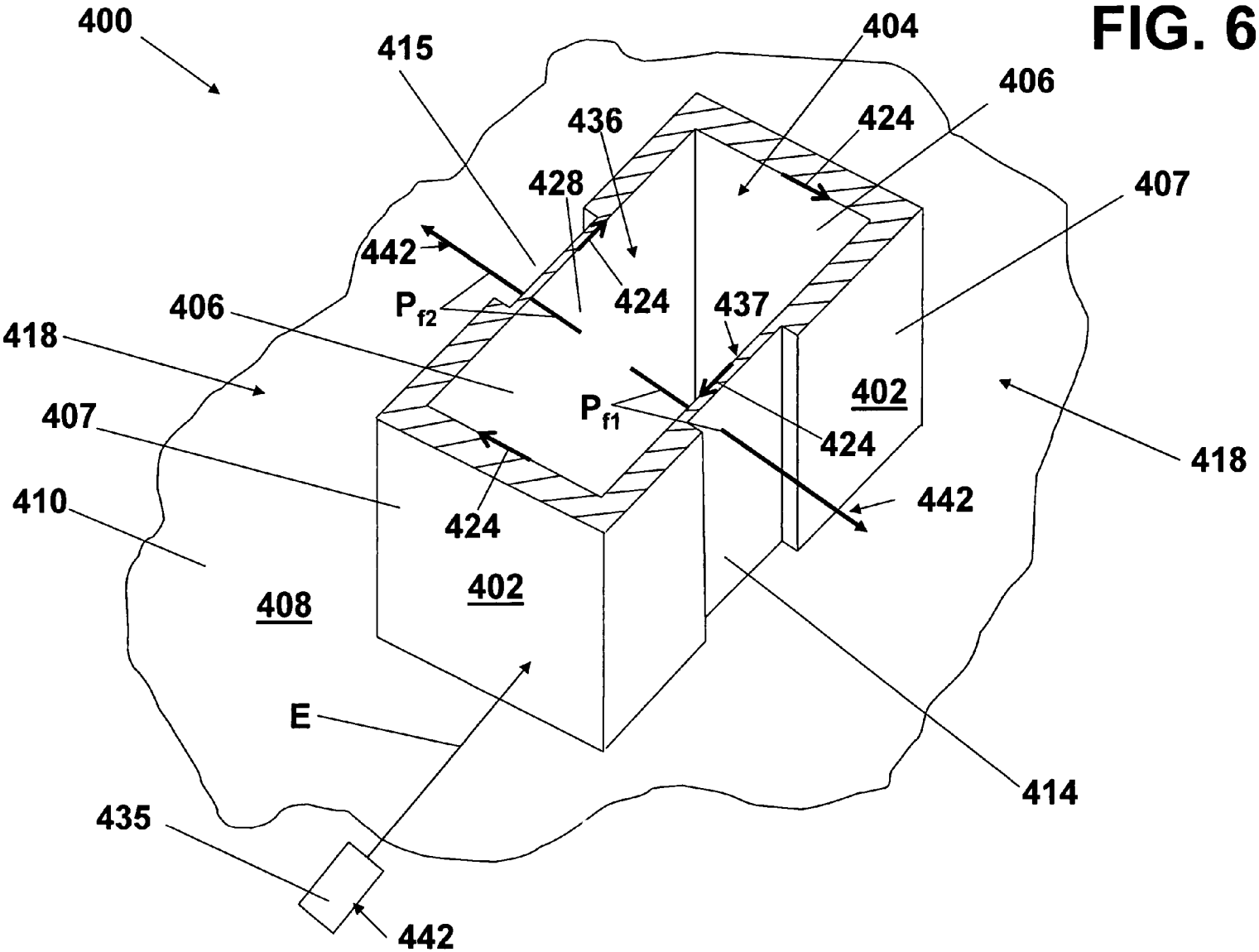
FIG. 6 is an enlarged topped-off, perspective-view illustrating a device having two windows.

FIG. 6 is an enlarged topped-off, perspective-view illustrating a device 400 in accordance with another embodiment of the present invention. FIG. 6 illustrates the device 400 comprising a wall 402 formed on a major surface 410 of a substrate 408. Similar to FIG. 1, the substrate 408 can be made of semiconductor materials, ceramics, plastics, metals and the like. The wall 402 includes inner 406 and outer 407 surfaces and is formed about a cavity 404. The inner surface 406 is exposed to the cavity 404. The wall 402 can be made with materials having a strong interaction with plasmons such as gold, silver, copper, aluminum and the like or a material that most easily supports charge density oscillations at the desired frequency range. The shape and size of the device 400 can be similar to device 100 under FIG. 1.

Windows 414 and 415 made from the wall 402 are disposed in the wall 402 and are electrically conductive. A surface or portion of the windows 414 and 415 is exposed to or adjacent to the cavity 404. This portion of the windows 414 and 415 can include the entire inner surface 406 and is referred to as a portion of the inner surface 428.

As shown in FIG. 6, energy (E) can be imparted to an outer surface 407 of the device 400 from an outside source 435. The outside source 435 can include another portion of the device as discussed later under FIG. 9. The energy (E) can be modulated by a signal 442 coupled to the outside source 435. Plasmons having varying fields can be stimulated by the energy (E) on the outer surface 407. The stimulated plasmons and varying fields can be coupled through the wall 402 from the outer 407 to the inner 406 surface. Surface current 424 is shown generated on the inner surface of the wall 402. Electromagnetic waves $P_{f1}$ and $P_{f2}$ carrying the signal 442 are generated within the cavity 404.

The windows 414 and 415 can be made to couple or pass electromagnetic waves. In particular, the windows 414 and 415 can be made to couple electromagnetic waves having distinct frequency ranges. For example, window 414 can be made to couple or pass the electromagnetic wave $P_{f1}$ having a frequency range from about 100 to about 600 terahertz. And, window 415 can be made to pass the electromagnetic wave $P_{f2}$ having a frequency range from about 800 terahertz to about 1000 terahertz. In a second example, the window 414 can be made to couple the electromagnetic wave $P_{f1}$ within the terahertz spectrum having a frequency below about 100 terahertz. Continuing the second example, the window 415 can be made to pass the electromagnetic wave $P_{f2}$ within the terahertz spectrum having a frequency above about 600 terahertz. It may also be possible to achieve this response using plasmon response versus frequency of the material. The respective examples can be referred to as pass-band and cut-off filtering methods.

In another example, a thin layer of silver acts as an Infrared blocking coating on the window while passing visible light. In general, higher frequency radiation corresponds to a smaller skin penetration depth and less transmission through the thin material.

Figure 7A:
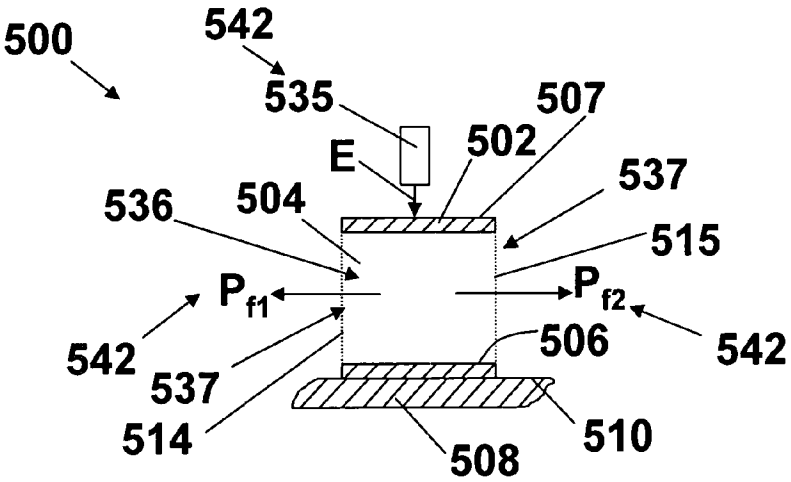
FIG. 7*a* is a schematic diagram illustrating energy coupled into a device and electromagnetic waves transferred out of the device.
Figure 7B:
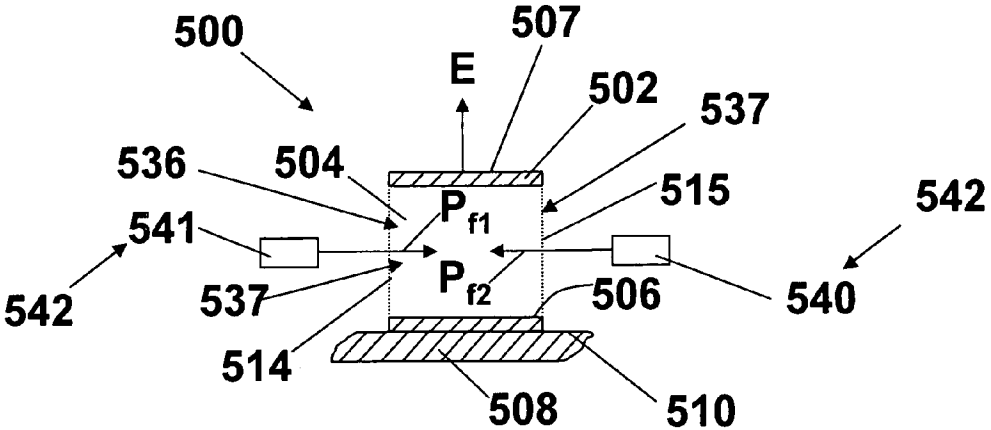
FIG. 7*b* is a schematic diagram illustrating the electromagnetic waves transferred into the device and the energy coupled out of the device.

FIGS. 7*a* and 7*b* are schematic diagrams illustrating alternative coupling devices 500. The device 500 is formed from a wall 502 that defines or encloses a cavity 504 and includes at least one window that forms at least a portion of the wall 502. In FIGS. 7*a* and 7*b*, plasmons can be stimulated from the outer 507 and inner 506 surfaces of the wall 502, respectively. In FIG. 7*a*, energy (E) is provided on the outer surface 507 by an outside source 535. The outside source 535 can include another portion of the device as discussed later under FIG. 9. The energy (E) can be modulated by a signal 542 coupled to the outside source 535. The energy arrow (E), as shown in FIG. 7*a*, is pointing toward the cavity 504, because the net energy transfer from the inner surface 506 to the outer 507 surface is generally toward the cavity 504. Plasmons having varying fields are stimulated by the energy (E) on the outer surface 507. The stimulated plasmons and varying fields are coupled through the wall 502 from the outer surface 507 to the inner surface 506. Electromagnetic waves $P_{f1}$ and $P_{f2}$ carrying the signal 442 are generated within the cavity 504. Electromagnetic waves $P_{f1}$ and $P_{f2}$ include distinct frequency ranges centered about frequencies f1 and f2, respectively.

Windows 514 and 515 made from the wall 502 are formed in the wall 502 and are electrically conductive. Further, the windows 514 and 515 can be made to couple or pass electromagnetic waves having distinct frequency ranges. For example, windows 514 and 515 can be made to pass the electromagnetic waves $P_{f1}$ and $P_{f2}$, respectively. In FIG. 7*b*, the electromagnetic waves $P_{f1}$ and $P_{f2}$ now provided from respective outside sources 541 and 540, which can be modulated by the signal 542. The outside sources 540 and 541 can include other portions of the device as discussed later under FIG. 9. The electromagnetic waves $P_{f1}$ and $P_{f2}$ can be coupled through the respective windows 514 and 515. Plasmons having varying fields are stimulated on the inner surface 506. As shown, energy (E) in the form of plasmons and varying fields can be coupled through the wall 502 from the inner surface 506 to the outer surface 507.

Figure 8B:
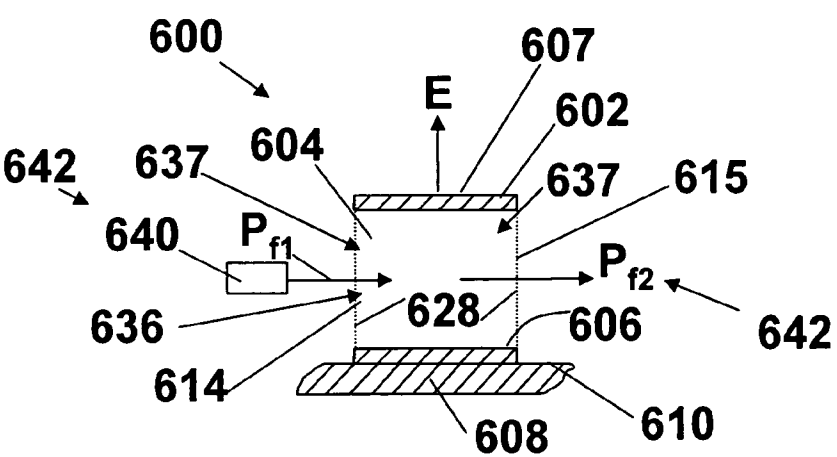
FIG. 8*b* is a schematic diagram illustrating the electromagnetic waves transferred into and out of the device and the energy coupled out of the device.
Figure 8D:
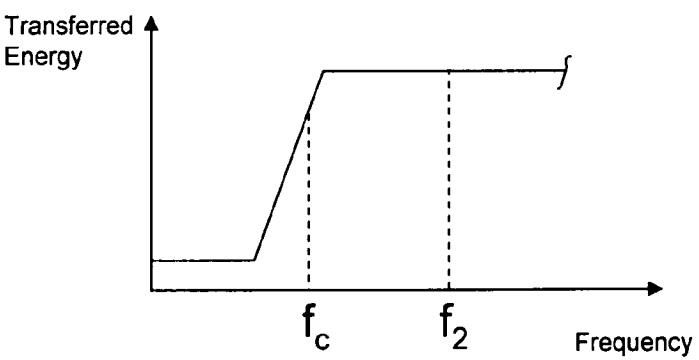
FIG. 8*d* is a diagram illustrating the response of transferred energy of an electromagnetic wave through a second window of the device in FIGS. 8*a* and 8*b*.
Figure 8A:
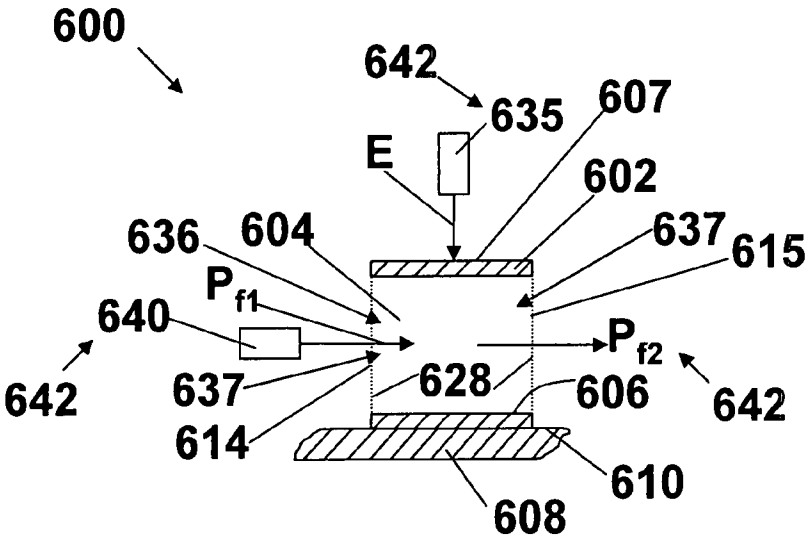
FIG. 8*a* is a schematic diagram illustrating energy coupled into a device and electromagnetic waves having two frequencies transferred into and out of the device.

FIGS. 8*a* and 8*b* are schematic diagrams illustrating another coupling device 600. The device 600 is formed from a wall 602 that defines or encloses a cavity 604 and includes windows 614 and 615. The windows 614 and 615 made from the wall 602 are formed in the wall 602 and are electrically conductive. In FIGS. 8*a* and 8*b*, plasmons can be stimulated at the outer 607 and inner 606 surfaces of the wall 602, respectively. In FIG. 8*a*, energy (E) is provided on the outer surface 607 by an outside source 635. The outside source 635 can include another portion of the device as discussed later under FIG. 9. The energy (E) can be modulated by a signal 642 coupled to the outside source 635. The energy (E) arrow, as shown in FIG. 8*a*, is pointing toward the cavity 604, because plasmons having varying fields are stimulated by the energy (E) on the outer surface 607. The stimulated plasmons and varying fields are coupled through the wall 602 from the outer surface 607 to the inner surface 606. The net energy transfer is generally toward the cavity 604. Further, an electromagnetic wave $P_{f1}$ having a distinct frequency range centered about frequency f1. Is provided from an outside source 640, which can be modulated by the signal 642. The outside source 640 can include another portion of the device as discussed later under FIG. 9.

Figure 8C:
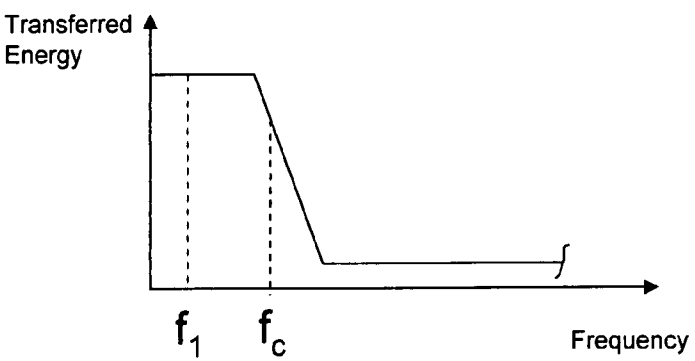
FIG. 8*c* is a diagram illustrating the response of transferred energy of an electromagnetic wave through a first window of the device in FIGS. 8*a* and 8*b;*

FIG. 8*c* is a diagram illustrating the response of the transferred energy of an electromagnetic wave through the window 614 in FIGS. 8*a* and 8*b*. Frequency $f_c$ is a cut-off frequency of the window 614, and electromagnetic waves having frequencies below about $f_c$ are generally coupled or passed through the window 614

In FIG. 8*a*, the electromagnetic wave $P_{f1}$ including a range of frequencies centered below the frequency $f_c$ is coupled through the window 614 and into a cavity 604 of the device 600. This further stimulates plasmons and varying fields on the inner surface 606. In response to the stimulation of the plasmons, the electromagnetic wave $P_{f2}$ carrying the signal 642 is generated in the cavity 604 and has a distinct frequency range centered about frequency f2.

FIG. 8*d* is a diagram illustrating the response of the transferred energy of an electromagnetic wave through the window 615 in FIGS. 8*a* and 8*b*. Frequency $f_c$ is a cut-off frequency of the window 615 and electromagnetic waves having frequencies above about $f_c$ are generally coupled or passed through the window 615.

In FIG. 8*a*, the electromagnetic wave $P_{f2}$ having a frequency $f_2$ above $f_c$ couples out of the cavity 604 through the window 615.

In FIG. 8*b*, the electromagnetic wave $P_{f1}$ carrying the signal 642 is provided from the outside source 640 and coupled through the window 614 into the cavity 604. Plasmons having varying fields are stimulated on the inner surface 606. As shown in FIG. 8*b*, the energy (E) arrow is pointing from the cavity 604, because the plasmons and varying fields are generally coupled through the wall 602 from the inner surface 606 to the outer surface 607. Further, the electromagnetic wave $P_{f2}$ carrying the signal 642 is generated within the cavity 604. The electromagnetic wave $P_{f2}$ couples out of the cavity 604 through the window 615.

Figure 9:
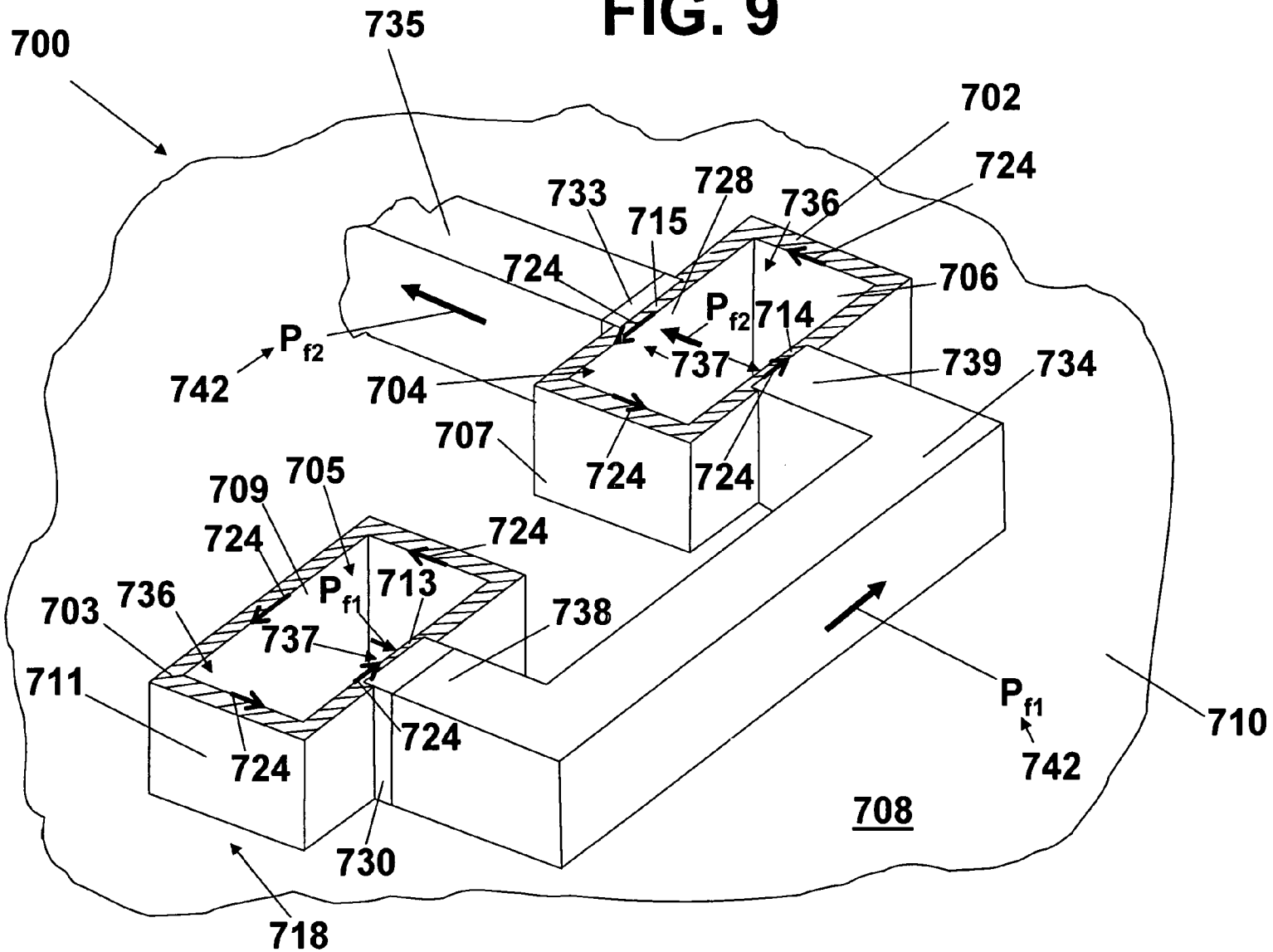
FIG. 9 is an enlarged topped-off, perspective-view of a device illustrating coupling an electromagnetic wave between two cavities.

FIG. 9 is an enlarged topped-off, perspective-view illustrating another coupling device 700. By topped-off one should not presume that the inventions described herein necessarily require tops. In some embodiments, the device will have no top. FIG. 9 illustrates the device 700 comprising walls 702 and 703 typically formed apart and on a surface 710 of a substrate 708. Similar to FIG. 1, the substrate 708 can be made of semiconductor materials, ceramics, plastics, metals and the like. The walls 702 and 703 are substantially closed geometric structures and define or enclose cavities 704 and 705, respectively. Inner surfaces 706 and 709 of the respective walls 702 and 703 are exposed to the cavities 704 and 705, respectively. The walls can be made of materials having a strong interaction with plasmons or other surface charge density wave such as gold, silver, copper, aluminum and the like.

A window 713 is disposed in the wall 703 and made from the wall 703 and is electrically conductive. Similarly, windows 714 and 715 are electrically conductive and made from and disposed on wall 702. A surface or portion of the windows 713, 714 and 715 is exposed to or adjacent to their respective cavities 704 and 705. This portion of the windows 713, 714 and 715 can include the entire respective inner surfaces 706 and 709 and is referred to as a portion of the inner surface 728.

The walls 702 and 703 include respective outer surfaces 707 and 711. Plasmons or other charge density waves having varying fields can be stimulated using at least two methods. As mentioned previously, plasmons having varying fields can be stimulated by applying energy on the outer surface, such as outer surfaces 707 and 711. This energy can be applied using an electromagnetic wave and carry a signal. The electromagnetic wave can be provided from the device 700 or from an outside source (not shown). A second method of stimulating plasmons having varying fields includes coupling the electromagnetic wave between cavities such as between cavities 704 and 705. This second method (described below) provides the advantage of applying various functions on the device 700 such as mixing, amplifying, filtering and the like.

Plasmons having varying field are stimulated on the inner surface 709 of cavity 705. Fields are generally intensified across the cavity 705. Surface current 724 is formed on the inner surface 709. As mentioned previously, the surface current such as the surface current 724 is not disrupted, because the portion of the inner surface 728 of the window 713 is generally flush with the inner surface 709 of the cavity 705. An electromagnetic wave $P_{f1}$ carrying a signal 742 is generated in cavity 705 and has a particular frequency distribution over a range of frequencies centered about a frequency f1. The window 713 can be made to selectively pass or couple distinct frequency ranges such as the particular frequency distribution centered about f1. The electromagnetic wave $P_{f1}$ is coupled out of the cavity 705 through the window 713.

Collectors 730 and 733 are shown in FIG. 9 adjacent to the respective windows 713 and 715. As mentioned under FIG. 5, the collectors 730 and 733 are used to reduce the scatter of an electromagnetic wave. The electromagnetic wave $P_{f1}$ emitted from the window 713 is coupled into the collector 730 to reduce scatter.

A wave coupler 734 is shown coupled between the windows 713 and 714. The wave coupler 734 can be made similar to the description as mentioned under FIG. 5 and can include a dielectric waveguide. From the collector 730, the electromagnetic wave $P_{f1}$ travels along the wave coupler 734. Next, the window 714 selectively passes the electromagnetic wave $P_{f1}$ into the cavity 704. The coupling of the electromagnetic wave $P_{f1}$ into the cavity 704 from the wave coupler 734 is an example of coupling from another portion of the device 700. As previously mentioned, an outside source can include another portion of the device.

After coupling through the window 714, the electromagnetic wave $P_{f1}$ is received in the cavity 704. Plasmons having varying fields are stimulated on the inner surface 706. The cavity 704 can be sized to a resonant frequency f2. For example, an electromagnetic wave $P_{f2}$ can carry the signal 742 and have a particular frequency distribution over a range of frequencies centered about a frequency f2 is generated in cavity 704. Similar to windows 713 and 714, window 715 can be made to can selectively pass or couple the electromagnetic wave $P_{f2}$.

The collector 733 coupled to window 715 receives the electromagnetic wave $P_{f2}$ carrying the signal 742. A wave coupler 735 coupled to the collector 733 next receives the electromagnetic wave $P_{f2}$, which can now be coupled to another location, such as another location on the device 700.

By now it should be appreciated that a method and device are provided that uses a window portion of a wall for coupling a signal. The device can be formed by the wall on a major surface of a substrate. The thickness of the window portion of the wall is substantially less than the wall. A combination of materials and thicknesses used for making the window portion of the wall can provide for filtering an electromagnetic wave used to carry the signal. Wave couplers can be used to couple the signal between cavities making up the device or between cavities of different devices.

Although certain preferred embodiments and methods have been disclosed herein, it will be apparent from the foregoing disclosure to those skilled in the art that variations and modifications of such embodiments and methods may be made without departing from the spirit and scope of the invention. It is intended that the invention shall be limited only to the extent required by the appended claims and the rules and principles of applicable law.

What is claimed is:

1. A device for coupling an electromagnetic wave, comprising:

a substrate;

a wall disposed on the substrate, the wall defining a resonant cavity to the electromagnetic wave at least one frequency between 0.1 THz and 7 PHz, and having an electrically conductive inner surface; and a window formed in the wall, and having a portion of the window adjacent to the cavity comprising at least a portion of the inner surface, wherein the electromagnetic wave is transmitted through the window to the cavity to induce resonance in the cavity, wherein the window comprises a thickness less than a penetration depth of the window.

2. A device for coupling an electromagnetic wave, comprising:

a substrate;

a wall disposed on the substrate, the wall defining a resonant cavity to the electromagnetic wave at least one frequency between 0.1 THz and 7 PHz, and having an electrically conductive inner surface; and a window formed in the wall, and having a portion of the window adjacent to the cavity comprising at least a portion of the inner surface, wherein the electromagnetic wave is transmitted through the window to the cavity to induce resonance in the cavity, wherein the window comprises a thickness greater than a penetration depth of the window.

3. A device for coupling an electromagnetic wave, comprising:

a substrate;

a wall disposed on the substrate, the wall defining a resonant cavity to the electromagnetic wave at least one frequency between 0.1 THz and 7 PHz, and having an electrically conductive inner surface; and a window formed in the wall, and having a portion of the window adjacent to the cavity comprising at least a portion of the inner surface, wherein the electromagnetic wave is transmitted through the window to the cavity to induce resonance in the cavity, wherein the window comprises a thickness generally equal to a penetration depth of the window.

4. The device of any one of claims 1-2, wherein the window is generally transparent.

5. The device of any one of claims 1-2, wherein the window is translucent.

6. The device of claim 5, wherein the transmittance of the window ranges from about 1 percent to about 99 percent.

7. The device of any one of claims 1-2, wherein the inner surface is flush with the window portion of the inner surface.

8. The device of any one of claims 1-2, wherein the window comprises a plurality of windows.

9. The device of any one of claims 1-2, wherein the wall comprises a micro-structure.

10. The device of any one of claims 1-2, wherein the wall comprises a micro-resonant structure.

11. The device of any one of claims 1-2, wherein the wall comprises a portion of a microcircuit.

12. A device for coupling an electromagnetic wave, comprising:

a substrate;

a wall disposed on the substrate, the wall defining a resonant cavity to the electromagnetic wave at least one frequency between 0.1 THz and 7 PHz, and having an electrically conductive inner surface; and a window formed in the wall, and having a portion of the window adjacent to the cavity comprising at least a portion of the inner surface, wherein the electromagnetic wave is transmitted through the window to the cavity to induce resonance in the cavity, further comprising a focusing device operatively associated with the window.

13. The device of claim 12, further comprising a wave coupler operatively associated with the focusing device.

14. The device of claim 13, further comprising a second window.

15. The device of claim 14, wherein the wave coupler is coupled to the second window.

16. A method for coupling a signal, comprising:

providing a wall disposed on a substrate, the wall defining a resonant cavity to the signal and having an electrically conductive inner surface;

forming a window in the wall, and having a portion of the window adjacent to the cavity comprising at least a portion of the inner surface;

transmitting an electromagnetic wave carrying the signal through the window to the cavity to induce resonance in the cavity; and providing energy to an outer surface of the wall and using the energy to stimulate plasmons having varying fields.

17. The method of claim 16, wherein using the energy to stimulate the plasmons comprises coupling the plasmons and the varying fields through the wall to the inner surface and generating the electromagnetic wave in the cavity.

18. The method of claim 17, wherein transmitting the electromagnetic wave through the window comprises passing the electromagnetic wave through the window and out of the cavity.

19. A method for coupling a signal, comprising:

providing a wall disposed on a substrate, the wall defining a resonant cavity to the signal and having an electrically conductive inner surface;

forming a window in the wall, and having a portion of the window adjacent to the cavity comprising at least a portion of the inner surface; and transmitting an electromagnetic wave carrying the signal through the window to the cavity to induce resonance in the cavity, wherein transmitting the electromagnetic wave through the window comprises receiving the electromagnetic wave through the window into the cavity and onto the inner surface, wherein receiving the electromagnetic wave comprises stimulating plasmons having varying fields on the inner surface.

20. The method of claim 19, wherein stimulating the plasmons comprises coupling the plasmons and the varying fields through the wall to provide energy on an outer surface.

21. A method for coupling a signal, comprising:

providing a wall disposed on a substrate, the wall defining a resonant cavity to the signal and having an electrically conductive inner surface;

forming a window in the wall, and having a portion of the window adjacent to the cavity comprising at least a portion of the inner surface; and transmitting an electromagnetic wave carrying the signal through the window to the cavity to induce resonance in the cavity;

wherein the window filters the electromagnetic wave to limit first and second frequency ranges that pass through the window, wherein coupling the electromagnetic wave comprises passing a first electromagnetic wave having the first frequency range through the window into the cavity and onto the inner surface;

providing energy to an outer surface and coupling the energy through the wall and onto the inner surface; and wherein transmitting the electromagnetic wave through the window and coupling the energy through the wall comprises stimulating plasmons having varying fields on the inner surface.

22. The method of claim 21, wherein stimulating the plasmons comprises generating a second electromagnetic wave having the second frequency range.

23. The method of claim 22, wherein generating the second electromagnetic wave comprises transmitting the second electromagnetic wave through the window and out of the cavity.

24. A method for coupling a signal, comprising:

providing a wall disposed on a substrate, the wall defining a resonant cavity to the signal and having an electrically conductive inner surface;

forming a window in the wall, and having a portion of the window adjacent to the cavity comprising at least a portion of the inner surface; and transmitting an electromagnetic wave carrying the signal through the window to the cavity to induce resonance in the cavity, wherein the window filters the electromagnetic wave to limit first and second frequency ranges that pass through the window, wherein transmitting the electromagnetic wave comprises passing a first electromagnetic wave having the first frequency range through the window into the cavity and onto an inner surface; and wherein passing the first electromagnetic wave comprises stimulating plasmons having varying fields on the inner surface.

25. The method of claim 24, wherein stimulating the plasmons comprises generating a second electromagnetic wave having the second frequency range and coupling energy through the wall and to an outer surface.

26. The method of claim 24, wherein generating the second electromagnetic wave comprises passing the second electromagnetic wave through the window and out of the cavity.

27. A method for coupling a signal, comprising:

providing a wall disposed on a substrate, the wall defining a cavity having an electrically conductive inner surface;

transmitting an electromagnetic wave carrying the signal through first and second windows, further comprising providing energy to an outer surface of the wall and using the energy to stimulate plasmons having varying fields; and providing the first and second windows disposed in the wall, and having a portion of at least one of the first and second windows adjacent to the cavity and comprising at least a portion of the inner surface, said first and second windows filtering the electromagnetic wave to limit first and second frequency ranges through the first and second windows, respectively.

28. The method of claim 27, wherein using the energy to stimulate the plasmons comprises coupling the plasmons and the varying fields through the wall to the inner surface and generating first and second electromagnetic waves having the respective first and second frequency ranges.

29. The method of claim 28, wherein generating the first and second electromagnetic waves comprises passing the first and second electromagnetic waves out of the device through the first and second windows, respectively.

30. A method for coupling a signal, comprising:

providing a wall disposed on a substrate, the wall defining a cavity having an electrically conductive inner surface;

providing first and second windows disposed in the wall, and having a portion of at least one of the first and second windows adjacent to the cavity and comprising at least a portion of the inner surface, said first and second windows filtering an electromagnetic wave to limit first and second frequency ranges through the first and second windows, respectively; and transmitting the electromagnetic wave carrying the signal through the first and second windows, wherein transmitting the electromagnetic wave comprises receiving first and second electromagnetic waves having the first and second frequency ranges, respectively; and wherein receiving the first and second electromagnetic waves comprises passing the first and second electromagnetic waves through the respective first and second windows into the cavity and onto the inner surface.

31. The method of claim 30, wherein passing the first and second electromagnetic waves comprises stimulating plasmons having varying fields on the inner surface.

32. The method of claim 31, wherein stimulating the plasmons having varying fields comprises coupling energy through the wall to an outer surface.

33. A method for coupling a signal, comprising:

providing a wall disposed on a substrate, the wall defining a cavity having an electrically conductive inner surface;

providing first and second windows disposed in the wall, and having a portion of at least one of the first and second windows adjacent to the cavity and comprising at least a portion of the inner surface, said first and second windows filtering an electromagnetic wave to limit first and second frequency ranges through the first and second windows, respectively; and transmitting the electromagnetic wave carrying the signal through the first and second windows, wherein transmitting the electromagnetic wave comprises receiving a first electromagnetic wave having a first frequency range through the first window into the cavity and onto the inner surface;

further comprising providing the energy to an outer surface and coupling energy through the wall and onto the inner surface; and wherein receiving the first electromagnetic wave and coupling the energy through the wall comprises stimulating plasmons having varying fields on the inner surface.

34. The method of claim 33, wherein stimulating the plasmons comprises generating a second electromagnetic wave having the second frequency range.

35. The method of claim 34, wherein generating the second electromagnetic wave comprises passing the second electromagnetic wave through the second window and out of the cavity.

36. The method of claim 35, wherein filtering to limit the first and second frequency ranges comprises respectively transmitting the first and second electromagnetic waves through the first and second windows below and above a cutoff frequency, respectively.

37. A method for coupling a signal, comprising:

providing a wall disposed on a substrate, the wall defining a cavity having an electrically conductive inner surface;

providing first and second windows disposed in the wall, and having a portion of at least one of the first and second windows adjacent to the cavity and comprising at least a portion of the inner surface, said first and second windows filtering an electromagnetic wave to limit first and second frequency ranges through the first and second windows, respectively; and transmitting the electromagnetic wave carrying the signal through the first and second windows, wherein transmitting the electromagnetic wave comprises receiving a first electromagnetic wave having the first frequency range through the first window into the cavity and onto the inner surface; and wherein passing the first electromagnetic wave comprises stimulating plasmons having varying fields on the inner surface.

38. The method of claim 37, wherein stimulating the plasmons comprises generating a second electromagnetic wave having the second frequency range and coupling energy to an outer surface.

39. The method of claim 38, wherein generating the second electromagnetic wave comprises passing the second electromagnetic wave through the second window and out of the cavity.

40. The method of claim 39, wherein filtering to limit the first and second frequency ranges comprises respectively transmitting the first and second electromagnetic waves through the first and second windows below and above a cutoff frequency, respectively.

* * * * *